US010332340B2

(12) United States Patent
Caputo et al.

(10) Patent No.: US 10,332,340 B2
(45) Date of Patent: Jun. 25, 2019

(54) GAMING SYSTEM AND METHOD PROVIDING A BONUS GAME CUSTOMIZABLE WITH ONE OR MORE FEATURES FROM MULTIPLE DIFFERENT PRIMARY GAMES

(71) Applicant: IGT, Las Vegas, NV (US)

(72) Inventors: Scott A. Caputo, Santa Clara, CA (US); Brian F. Saunders, Sunnyvale, CA (US)

(73) Assignee: IGT, Las Vegas, NV (US)

( * ) Notice: Subject to any disclaimer, the term of this patent is extended or adjusted under 35 U.S.C. 154(b) by 615 days.

(21) Appl. No.: 14/289,173

(22) Filed: May 28, 2014

(65) Prior Publication Data

US 2015/0348355 A1 Dec. 3, 2015

(51) Int. Cl.
*G07F 17/32* (2006.01)

(52) U.S. Cl.
CPC ..... *G07F 17/3227* (2013.01); *G07F 17/3262* (2013.01); *G07F 17/3267* (2013.01)

(58) Field of Classification Search
CPC ..... G07F 17/32; G07F 17/3227; G07F 17/3262; G07F 17/3267
See application file for complete search history.

(56) References Cited

U.S. PATENT DOCUMENTS 5,833,537 A 11/1998 Barrie
5,967,893 A 10/1999 Lawrence et al.
6,010,404 A 1/2000 Walker et al.
6,117,009 A 9/2000 Yoseloff
6,146,271 A * 11/2000 Kadlic ..... A63F 1/00 273/292
6,159,096 A 12/2000 Yoseloff
6,174,235 B1 1/2001 Walker et al.
6,186,894 B1 2/2001 Mayeroff
6,224,483 B1 5/2001 Mayeroff
6,309,300 B1 10/2001 Glavich
6,311,976 B1 11/2001 Yoseloff et al.
(Continued)

OTHER PUBLICATIONS

Jazzy Jackpots Advertisement, copyright Atronic 2000 (4 pages).
Jazzy Jackpots Article, Strictly Slots, Mar. 2001 (1 page).

*Primary Examiner* — David Duffy
*Assistant Examiner* — Ankit B Doshi
(74) *Attorney, Agent, or Firm* — Neal, Gerber & Eisenberg LLP

(57) ABSTRACT

Various embodiments of the present disclosure provide a gaming system and method providing a bonus game customizable with features of one or more primary games. In various embodiments, the gaming system may trigger the customizable bonus game in association with a play of any one of a plurality of different primary games, each of which includes one or more features. Before providing a play of the customizable bonus game, the gaming system modifies the customizable bonus game to include one of the features of the primary game that triggered the customizable bonus game that is not included in any of the other primary games. The modification is in addition to at least one prior modification of the customizable bonus game. Thus, the gaming system enables a player to customize the combination of features included in the customizable bonus game by playing a variety of different primary games.

20 Claims, 20 Drawing Sheets

(56) References Cited

U.S. PATENT DOCUMENTS 6,315,664 B1 11/2001 Baerlocher et al.
6,319,124 B1 11/2001 Baerlocher et al.
6,331,143 B1 12/2001 Yoseloff
6,364,767 B1 4/2002 Brossard et al.
6,398,645 B1 6/2002 Yoseloff
6,439,995 B1 8/2002 Hughs-Baird et al.
6,450,883 B1 9/2002 O'Halloran
6,461,241 B1 10/2002 Webb et al.
6,511,375 B1 1/2003 Kaminkow
6,514,141 B1 2/2003 Kaminkow et al.
6,561,899 B2 5/2003 Vancura
6,561,902 B1 5/2003 Walker et al.
6,569,016 B1 5/2003 Baerlocher
6,582,307 B2 6/2003 Webb
6,592,457 B1 * 7/2003 Frohm ..... G07F 17/32 273/138.1
6,599,185 B1 7/2003 Kaminkow et al.
6,602,137 B2 8/2003 Kaminkow et al.
6,609,971 B2 8/2003 Vancura
6,634,943 B1 10/2003 Baerlocher
6,666,766 B2 12/2003 Baerlocher et al.
6,676,516 B2 1/2004 Baerlocher et al.
6,688,977 B1 2/2004 Baerlocher et al.
6,726,563 B1 4/2004 Baerlocher et al.
6,731,313 B1 5/2004 Kaminkow
6,733,386 B2 5/2004 Cuddy et al.
6,733,389 B2 5/2004 Webb et al.
6,758,749 B2 7/2004 Krintzman
6,769,983 B2 8/2004 Slomiany
6,769,986 B2 8/2004 Vancura
6,780,107 B2 8/2004 Baerlocher et al.
6,780,111 B2 8/2004 Cannon et al.
6,783,457 B2 8/2004 Hughs-Baird et al.
6,786,819 B2 9/2004 Baerlocher et al.
6,793,578 B2 9/2004 Luccesi et al.
6,796,902 B2 9/2004 Baerlocher et al.
6,832,957 B2 12/2004 Falconer
6,837,788 B2 1/2005 Cannon
6,875,108 B1 4/2005 Hughs-Baird
6,877,745 B1 4/2005 Walker et al.
6,884,165 B2 4/2005 Baerlocher
6,899,620 B2 5/2005 Kaminkow et al.
6,910,962 B2 6/2005 Marks et al.
6,918,834 B2 7/2005 Vancura
6,932,701 B2 8/2005 Glavich et al.
6,958,013 B2 10/2005 Miereau et al.
6,966,834 B1 11/2005 Johnson
6,986,709 B2 1/2006 Hughs-Baird et al.
6,997,805 B2 2/2006 Vancura
7,001,278 B2 2/2006 Maya et al.
7,004,834 B2 2/2006 Walker et al.
7,037,191 B2 5/2006 Rodgers et al.
7,040,984 B2 5/2006 Mead
7,121,942 B2 10/2006 Baerlocher
7,160,189 B2 1/2007 Walker et al.
7,172,506 B2 2/2007 Baerlocher et al.
7,201,657 B2 4/2007 Baerlocher et al.
7,235,011 B2 6/2007 Randall et al.
7,264,545 B2 9/2007 Maya et al.
7,273,415 B2 9/2007 Cregan et al.
7,278,919 B2 10/2007 Souza et al.
7,300,348 B2 11/2007 Kaminkow et al.
7,314,409 B2 1/2008 Maya et al.
7,316,609 B2 1/2008 Dunn et al.
7,341,513 B2 3/2008 Cuddy et al.
7,371,166 B1 5/2008 Webb et al.
7,371,174 B2 5/2008 Baerlocher
7,377,849 B2 5/2008 Baerlocher et al.
7,413,510 B2 8/2008 Schlegel et al.
7,427,233 B2 9/2008 Walker et al.
7,481,709 B2 1/2009 Bussick et al.
7,513,828 B2 4/2009 Nguyen et al.
7,544,129 B2 6/2009 Baerlocher
7,547,252 B2 6/2009 Peterson et al.
7,566,267 B2 7/2009 Vancura
7,566,271 B2 7/2009 Hostetler et al.
7,585,218 B2 9/2009 Mead et al.
7,591,722 B2 9/2009 Baerlocher et al.
7,597,618 B2 10/2009 Webb et al.
7,674,180 B2 3/2010 Graham et al.
7,690,981 B2 4/2010 Ching et al.
7,695,363 B2 4/2010 Gilliland et al.
7,699,699 B2 4/2010 Gilliland et al.
7,722,458 B2 5/2010 Walker et al.
7,726,655 B2 6/2010 Walker et al.
7,749,080 B2 7/2010 Szrek et al.
7,758,416 B2 7/2010 Randall
7,785,188 B2 8/2010 Cannon
7,789,755 B2 9/2010 Davis et al.
7,806,760 B2 10/2010 Baerlocher
7,815,503 B2 10/2010 Walker et al.
7,850,522 B2 12/2010 Walker et al.
7,862,430 B2 1/2011 Baerlocher et al.
7,867,074 B2 1/2011 Gerrard et al.
7,867,080 B2 1/2011 Nicely et al.
7,871,323 B2 1/2011 Walker et al.
7,874,904 B2 1/2011 Randall
7,887,409 B2 2/2011 Baerlocher et al.
7,909,690 B2 3/2011 Low
7,914,373 B2 3/2011 Webb et al.
7,985,133 B2 7/2011 Baerlocher et al.
8,002,620 B2 8/2011 Nicely et al.
8,012,013 B2 9/2011 Walker et al.
8,012,014 B2 9/2011 Low et al.
8,043,153 B2 10/2011 Ross et al.
8,079,903 B2 12/2011 Nicely et al.
8,092,299 B2 1/2012 Cohen et al.
8,092,302 B2 1/2012 Cuddy et al.
8,109,821 B2 2/2012 Kovacs et al.
8,113,946 B2 2/2012 Walker et al.
8,118,662 B2 2/2012 Caputo et al.
8,133,105 B2 3/2012 Walker et al.
8,142,280 B2 3/2012 Walker et al.
8,152,624 B2 4/2012 Gerrard et al.
8,152,630 B2 4/2012 Cohen
8,157,633 B2 4/2012 Kaminkow
8,192,276 B2 6/2012 Walker et al.
8,221,206 B2 7/2012 Marks et al.
8,226,467 B2 7/2012 Weber et al.
8,231,450 B2 7/2012 Larsen
8,262,455 B2 9/2012 Caputo et al.
8,287,364 B2 10/2012 Caputo et al.
8,333,657 B1 12/2012 Nelson et al.
8,376,836 B2 2/2013 Baerlocher et al.
8,382,572 B2 2/2013 Hoffman et al.
8,408,990 B2 4/2013 De Waal et al.
8,425,303 B2 4/2013 Kennedy et al.
8,425,306 B2 4/2013 Low
8,460,090 B1 6/2013 Gilliland
8,512,120 B2 8/2013 Nelson et al.
8,512,130 B2 8/2013 Muir
2002/0045474 A1 * 4/2002 Singer ..... G07F 17/32 463/20
2003/0232640 A1 12/2003 Walker et al.
2004/0005919 A1 * 1/2004 Walker ..... G07F 17/32 463/23
2004/0198481 A1 * 10/2004 Herrington ..... G07F 17/32 463/13
2005/0054435 A1 3/2005 Rodgers et al.
2005/0239539 A1 10/2005 Inamura
2006/0030401 A1 2/2006 Mead et al.
2006/0046818 A1 3/2006 Goins
2006/0073884 A1 4/2006 Walker et al.
2006/0105836 A1 * 5/2006 Walker ..... G07F 17/32 463/25
2006/0252506 A1 11/2006 Walker et al.
2007/0265054 A1 11/2007 Walker et al.
2007/0275777 A1 11/2007 Walker et al.
2008/0076542 A1 3/2008 Iddings et al.
2008/0182650 A1 7/2008 Randall et al.
2008/0234021 A1 9/2008 Palmer et al.
2010/0081497 A1 4/2010 Wolf et al.
2010/0133122 A1 6/2010 Ozaki et al.
2010/0137056 A1 6/2010 Hoffman et al.

(56) References Cited

U.S. PATENT DOCUMENTS

| | | | |
|---|---|---|---|
| 2011/0003627 | A1 | 1/2011 | Nicely et al. |
| 2011/0111828 | A1 | 5/2011 | Caputo et al. |
| 2012/0214580 | A1 | 8/2012 | Hoffman et al. |
| 2013/0079116 | A1 | 3/2013 | Nelson et al. |
| 2013/0079123 | A1 | 3/2013 | Nicely et al. |
| 2013/0084941 | A1 | 4/2013 | Caputo et al. |
| 2013/0225268 | A1 | 8/2013 | Caputo et al. |
| 2015/0072766 | A1 | 3/2015 | Hughes et al. |

* cited by examiner

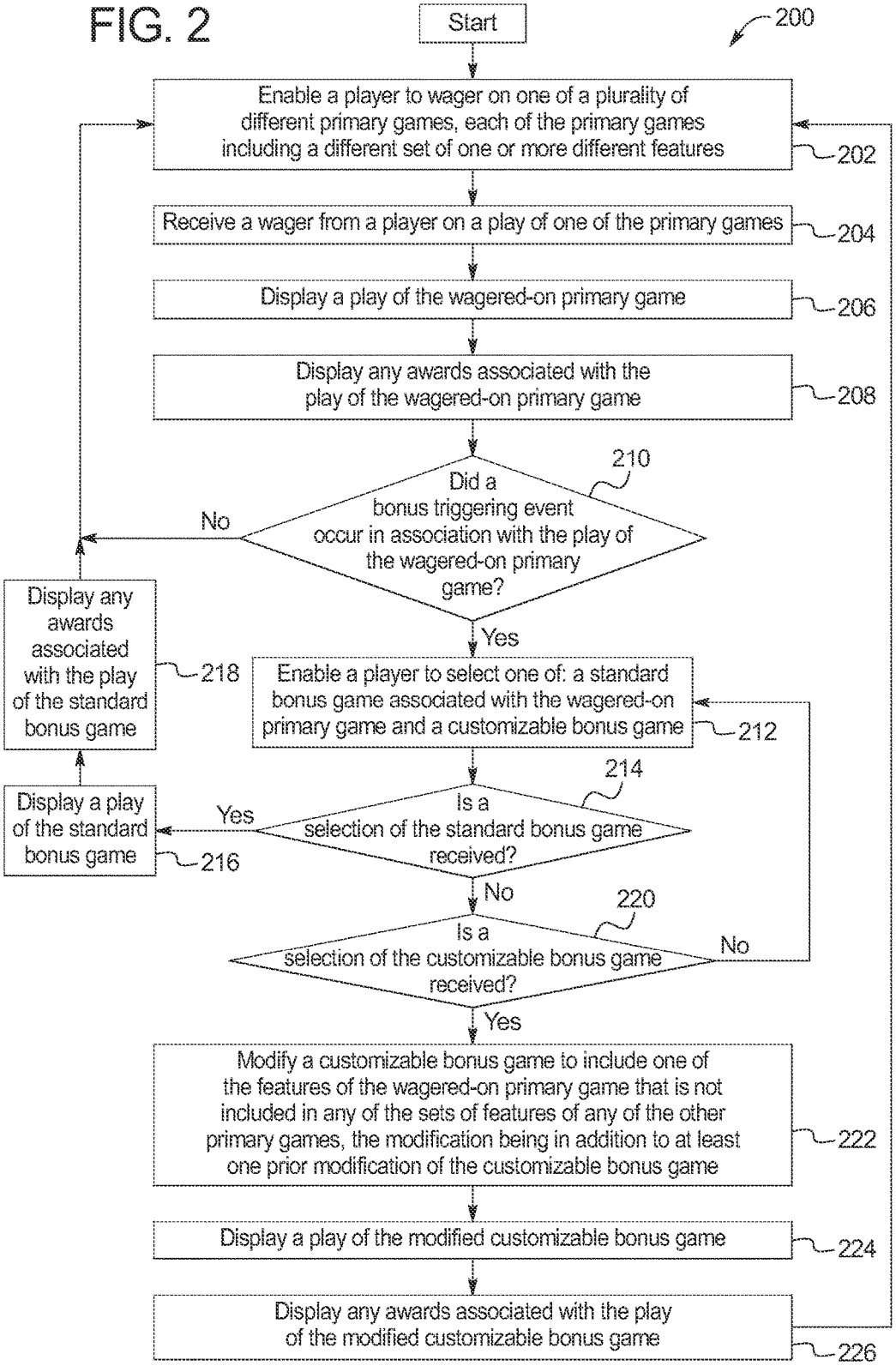
FIG. 2
Start
200
Enable a player to wager on one of a plurality of different primary games, each of the primary games including a different set of one or more different features
202
Receive a wager from a player on a play of one of the primary games
204
Display a play of the wagered-on primary game
206
Display any awards associated with the play of the wagered-on primary game
208
Did a bonus triggering event occur in association with the play of the wagered-on primary game?
210
No
Yes
Display any awards associated with the play of the standard bonus game
218
Enable a player to select one of: a standard bonus game associated with the wagered-on primary game and a customizable bonus game
212
Is a selection of the standard bonus game received?
214
Yes
Display a play of the standard bonus game
216
No
Is a selection of the customizable bonus game received?
220
No
Yes
Modify a customizable bonus game to include one of the features of the wagered-on primary game that is not included in any of the sets of features of any of the other primary games, the modification being in addition to at least one prior modification of the customizable bonus game
222
Display a play of the modified customizable bonus game
224
Display any awards associated with the play of the modified customizable bonus game
226

GAMING SYSTEM AND METHOD PROVIDING A BONUS GAME CUSTOMIZABLE WITH ONE OR MORE FEATURES FROM MULTIPLE DIFFERENT PRIMARY GAMES

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Certain known gaming systems provide predictable, non-interactive, and non-customizable bonus games, such as a bonus game including a designated quantity of free spins of five bonus reels or a designated quantity of player picks of a plurality of selections. While these known bonus games are initially enjoyable, the predictable, passive, and non-customizable nature of these known bonus games becomes monotonous and boring for certain players after a certain amount time. A continuing need thus exists to provide new, exciting, and engaging bonus games that facilitate player interaction and bonus game customization and vary bonus game play over time.

SUMMARY

Various embodiments of the present disclosure provide a gaming system and method providing a bonus game customizable with one or more features from multiple different primary games. Generally, in various embodiments, the gaming system is configured to trigger the customizable bonus game in association with a play of any one of a plurality of different primary games, each of which includes a different set of one or more different features. Before providing a play of the customizable bonus game, the gaming system modifies the customizable bonus game to include one of the features of the set of features of the primary game that triggered the customizable bonus game that is not included in any of the sets of features of any of the other primary games. That is, the gaming system modifies the customizable bonus game to include a feature unique to the particular primary game that triggered the customizable bonus game. In these embodiments, the modification is in addition to at least one prior modification (if any) of the customizable bonus game. Thus, the gaming system enables a player to customize the combination of features included in the customizable bonus game by playing (and triggering the customizable bonus game during play of) a variety of different primary games.

In certain embodiments, the gaming system modifies and provides a play of the customizable bonus game upon an occurrence of a bonus triggering event in association with a play of one of the plurality of primary games.

More specifically, in one such embodiment, the gaming system is configured to trigger the customizable bonus game in association with a play of any of a first primary game including a first set of one or more features and a second different primary game including a second set of one or more features. In this embodiment, the first set of features includes at least one feature not included in the second set of features, and the second set of features includes at least one feature not included in the first set of features. In operation of this embodiment, at a first point in time following an occurrence of a first bonus triggering event in association with a play of the first primary game, the gaming system modifies the customizable bonus game to include one of the features of the first set that is not included in the second set of features and displays a play of the modified customizable bonus game. At a second subsequent point in time following an occurrence of a second bonus triggering event in association with a play of the second primary game, the gaming system further modifies the customizable bonus game to include one of the features of the second set that is not included in the first set of features of the first primary game. The gaming system displays a play of the further modified customizable bonus game.

In another such embodiment, the gaming system is configured to trigger the customizable bonus game in association with a play of any of: a first primary game, and a second different primary game. In operation of this embodiment, at a first point in time following an occurrence of a first bonus triggering event in association with a play of the first primary game, the gaming system displays a play of a first bonus game having a first set of one or more features. At least one of the features of the first set is included in the first primary game and is not included in the second primary game. At a second subsequent point in time following an occurrence of a second bonus triggering event in association with a play of the second primary game, the gaming system displays a play of a second bonus game having a second set of one or more features. The second set of features includes the features of the first set and at least one additional feature that is included in the second primary game and is not included in the first primary game.

In other embodiments, each of the primary games is associated with a standard or designated bonus game in addition to the customizable bonus game. In these embodiments, when the bonus triggering event occurs in association with a play of one of the primary games, the gaming system enables the player to choose whether to play the standard bonus game associated with that particular primary game or the customizable bonus game.

In another embodiment, the gaming system is configured to trigger the customizable bonus game in association with a play of any of a plurality of different primary games, each of which includes a different set of one or more different features and each of which is associated with a different standard bonus game. In operation of this embodiment, the gaming system receives a wager from a player on one of the plurality of different primary games. The gaming system displays a play of the wagered-on primary game and displays any awards associated with the play of the wagered-on primary game. If a bonus triggering event occurs in association with the play of the wagered-on primary game, the gaming system enables the player to select one of: the standard bonus game associated with the wagered-on primary game and the customizable bonus game. If the gaming system receives a selection of the standard bonus game, the gaming system displays a play of the standard bonus game. If, on the other hand, the gaming system receives a selection of the customizable bonus game, the gaming system modifies the customizable bonus game to include one of the features of the set of features of the wagered-on primary game that is not included in any of the sets of features of any of the other primary games. The modification is in addition to at least one of any prior modifications of the customizable bonus game. The gaming system displays a play of the modified customizable bonus game.

In another embodiment, the gaming system is configured to trigger the customizable bonus game in association with a play of any of a first primary game including a first set of one or more features and a second different primary game including a second set of one or more features. In this embodiment, the first set of features includes at least one feature not included in the second set of features, and the second set of features includes at least one feature not included in the first set of features. In operation of this embodiment, the gaming system displays a play of the first primary game upon a first wager by a player. If a first bonus triggering event occurs in association with the play of the first primary game, the gaming system enables the player to select one of a first bonus game associated with the first primary game, and the customizable bonus game. If the gaming system receives a selection of the first bonus game, the gaming system displays a play of the first bonus game. If, on the other hand, the gaming system receives a selection of the customizable bonus game, the gaming system modifies the customizable bonus game to include one of the features of the first set and displays a play of the modified customizable bonus game.

Subsequently, the gaming system displays a play of the second primary game upon a second wager by the player. If a second bonus triggering event occurs in association with the play of the second primary game, the gaming system enables the player to select one of: a second bonus game associated with the second primary game, and the customizable bonus game. The second bonus game is different from the first bonus game. If the gaming system receives a selection of the second bonus game, the gaming system displays a play of the second bonus game. If, on the other hand, the gaming system receives a selection of the customizable bonus game, the gaming system modifies the customizable bonus game to include one of the features of the second set, the modification being in addition to at least one of any prior modifications of the customizable bonus game, and displays a play of the modified customizable bonus game.

It should thus be appreciated that the gaming system and method of the present disclosure provide a new, exciting, and engaging bonus game that facilitates player interaction and bonus game customization and varies bonus game play over time.

Additional features and advantages are described herein, and will be apparent from, the following Detailed Description and the Figures.

BRIEF DESCRIPTION OF THE FIGURES

FIG. 2 is a flowchart illustrating an example method of operating another embodiment of the gaming system of the present disclosure.

DETAILED DESCRIPTION

Bonus Game Customizable with One or More Features from Multiple Different Primary Games Various embodiments of the present disclosure provide a gaming system and method providing a bonus game customizable with one or more features from multiple different primary games. Generally, in various embodiments, the gaming system is configured to trigger the customizable bonus game in association with a play of any one of a plurality of different primary games, each of which includes a different set of one or more different features. Before providing a play of the customizable bonus game, the gaming system modifies the customizable bonus game to include one of the features of the set of features of the primary game that triggered the customizable bonus game that is not included in any of the sets of features of any of the other primary games. That is, the gaming system modifies the customizable bonus game to include a feature unique to the particular primary game that triggered the customizable bonus game (with respect to at least the other primary games). In these embodiments, the modification is in addition to at least one prior modification (if any) of the customizable bonus game. Thus, the gaming system enables a player to customize the combination of features included in the customizable bonus game by playing (and triggering the customizable bonus game during play of) a variety of different primary games.

In certain embodiments, the gaming system modifies and provides a play of the customizable bonus game upon an occurrence of a bonus triggering event in association with a play of one of the plurality of primary games. In one embodiment, the bonus triggering event that triggers the customizable bonus game is the same for each of the primary games. For instance, in one example embodiment, each of the primary games is a slot game having Bonus symbols on the reels, and the bonus triggering event occurs when a designated combination of the Bonus symbols is displayed following a spin of the reels. In another embodiment, the bonus triggering event that triggers the customizable bonus game is different for at least two of the primary games.

Figure 1:
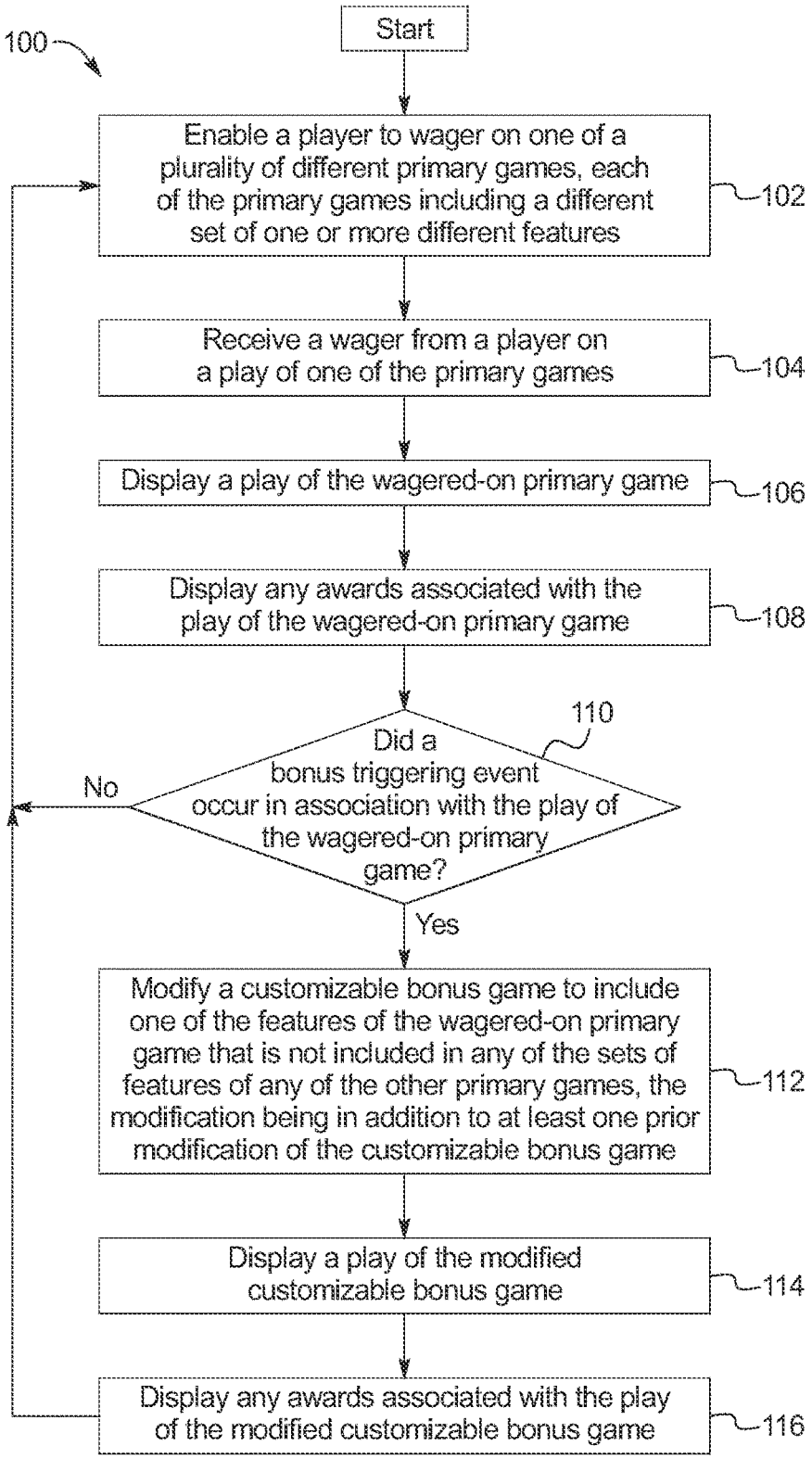
FIG. 1 is a flowchart illustrating an example method of operating one embodiment of the gaming system of the present disclosure.

FIG. 1 illustrates a flowchart of an example process or method 100 of operating one such embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the process 100 begins when the gaming system receives a deposit of value from a player. The gaming system enables the player to wager on one of a plurality of different primary games, each of which includes a different set of one or more different features, as indicated by block 102. In other words, in this example embodiment, each of the primary games includes at least one feature that is not included in any of the sets of features of any of the other primary games. The gaming system receives a wager from the player on a play of one of the primary games, as indicated by block 104. The gaming system displays a play of the wagered-on primary game, as indicated by block 106, and displays any awards associated with the play of the wagered-on primary game, as indicated by block 108.

The gaming system determines if a bonus triggering event occurred in association with the play of the wagered-on primary game, as indicated by diamond 110. If the gaming system determines that the bonus triggering event did not occur in association with the play of the wagered-on primary game, the process 100 returns to the block 102 and again enables the player to wager on one of the plurality of different primary games. If, on the other hand, the gaming system determines that the bonus triggering event occurred in association with the play of the wagered-on primary game, the gaming system modifies a customizable bonus game to include one of the features of the wagered-on primary game that is not included in any of the sets of features of any of the other primary games, as indicated by block 112. In other words, in this example embodiment, the gaming system modifies the customizable bonus game to include a feature unique to the wagered-on primary game (with respect to at least the other primary games).

The modification of the customizable bonus game is in addition to at least one of any prior modifications of the customizable bonus game. For instance, if the gaming system previously modified the customizable bonus game to include a first feature of a first primary game and the bonus triggering event subsequently occurred in association with a play of a second different primary game, the gaming system further modifies the customizable bonus game to include a second feature of the second primary game in addition to the first feature. After modifying the customizable bonus game, the gaming system displays a play of the modified customizable bonus game, as indicated by block 114, and displays any awards associated with the play of the modified customizable bonus game, as indicated by block 116. The process 100 then returns to the block 102, and the gaming system again enables the player to wager on one of the plurality of different primary games.

In certain embodiments, the gaming system enables the player to wager on and play any of the plurality of primary games at a single electronic gaming machine (EGM), while in other embodiments the gaming system enables the player to wager on and play the primary games at different EGMs.

The set of features of a particular primary game may include any suitable feature or features such as, but not limited to, one or more of: (1) Wild symbols; (2) modifier Wild symbols (e.g., 2× Wild symbols); (3) roaming Wild symbols; (4) expanding Wild symbols; (5) randomly awarded Wild symbols; (6) modifier symbols (e.g., 2× and 3× multipliers); (7) a tumbling reels or cascading symbols feature; (8) a symbol replacement feature; (9) a bonus retrigger feature; (10) a symbol transformation feature; (11) a stacked symbols feature (e.g., a stacked Wild symbols feature); (12) a progressive award feature; (13) a particular theme; (14) a particular set of symbols; (15) a particular background; (16) particular sound effects; (17) particular animations; (18) a reel re-spin feature; (19) a reel nudge feature; (20) a locking Wilds feature; (21) a locking reels feature; (22) split symbols (e.g., multiple symbols displayed at a single symbol display area); (23) designated symbols that trigger a sub-bonus feature when displayed; (24) different reel configurations (e.g., independent reels or larger reels (such as 8×5 reels)); (25) different quantities of paylines; (26) different types of award evaluations (e.g., payline-based award evaluation, multiway award evaluation, and/or scatter pay award evaluation); (27) a persistent game feature that is locked after repeat plays; (28) a mystery feature that can occur (such as randomly) on any spin that causes the gaming system to provide an award to the player (such as free spins or a modifier); (29) a symbol accumulation feature (such as a feature that enables a player to collect designated symbols over a plurality of game plays and that causes the gaming system to provide an award when the player has collected a designated quantity of designated symbols); and (30) a symbol substitution feature (e.g., when a triggering event occurs, the gaming system substitutes low-value symbols with high-value symbols or Wild symbols).

As noted above, in various embodiments, before displaying a play of the customizable bonus game following an occurrence of a bonus triggering event in association with a play of a wagered-on primary game, the gaming system modifies the customizable bonus game to include at least one feature of the wagered-on primary game that is not included in any of the sets of features of any of the other primary games.

In one embodiment, the gaming system modifies the customizable bonus game to include at least one feature of the wagered-on primary game only if the wagered-on primary game includes at least one feature that is both not already included in the customizable bonus game and that is not included in any of the sets of features of any of the other primary games. In other words, in this embodiment, once the gaming system has modified the customizable bonus game to include all of the unique features (with respect to at least the other primary games) of a particular primary game, the gaming system does not further modify the customizable bonus game when that particular primary game triggers the customizable bonus game. This encourages players to play different games to attempt to cause the gaming system to further modify the customizable bonus game. For instance, in one example embodiment, a first primary game is associated with two unique features: (1) Wild symbol stacks, and (2) 3× Wild symbols. In this example embodiment, the gaming system has already modified the customizable bonus game to include these two unique features. Thereafter, the bonus triggering event occurs in association with a play of the first primary game. In this example embodiment, because the gaming system has already modified the customizable bonus game to include the two unique features of the first primary game, the gaming system does not further modify the customizable bonus game before providing a play of the customizable bonus game.

In another embodiment, if the bonus triggering event occurs in association with a play of a wagered-on primary game and the gaming system has already modified the customizable bonus game to include all of the unique features (with respect to at least the other primary games) of the wagered-on primary game, the gaming system further modifies the customizable bonus game to include a feature (if any) that is: (a) included in the wagered-on primary game, (b) included in at least one other primary game, and (c) not already included in the customizable bonus game. Thus, in this embodiment, the gaming system modifies the customizable bonus game to include a feature included in a plurality of the primary games when the gaming system has already modified the customizable bonus game to include the unique features of the wagered-on primary game (with respect to at least the other primary games). For instance, in one example embodiment, a first primary game is associated with one unique feature—Wild symbol stacks—and one feature that is included in at least one other primary game—3× Wild symbols. In this example embodiment, the gaming system has already modified the customizable bonus game to include Wild symbol stacks. Thereafter, the bonus triggering event occurs in association with a play of the first primary game. In this example embodiment, because the gaming system has already modified the customizable bonus game to include Wild symbol stacks and because the customizable bonus game does not include 3× Wild symbols, the gaming system further modifies the customizable bonus game to include 3× Wild symbols.

In another embodiment, if the bonus triggering event occurs in association with a play of a wagered-on primary game and the gaming system has already modified the customizable bonus game to include all of the unique features (with respect to the other primary games) of the wagered-on primary game, the gaming system further modifies the customizable bonus game by increasing the value of one of those features. For instance, in one example embodiment, a first primary game is associated with two unique features: (1) Wild symbol stacks, and (2) 3× Wild symbols. In this example embodiment, the gaming system has already modified the customizable bonus game to include these two unique features. Thereafter, the bonus triggering event occurs in association with a play of the first primary game. In this example embodiment, because the gaming system has already modified the customizable bonus game to include the two unique features of the first primary game, the gaming system further modifies the customizable bonus game by either increasing the value of the 3× Wild symbols to 4× Wild symbols or increasing the quantity of Wild symbols in the Wild symbol stacks.

In another embodiment, if the bonus triggering event occurs in association with a wagered-on primary game and the gaming system has already modified the customizable bonus game to include all of the features (unique with respect to the other primary games or not) of the wagered-on primary game, the gaming system further modifies the customizable bonus game by increasing the value of one of those features. In one instance, the gaming system increases the value of one of the unique features of that primary game (with respect to at least the other primary games) included in the customizable bonus game. For instance, in one example embodiment, a first primary game is associated with two unique features—Wild symbol stacks and 3× Wild symbols—and one non-unique feature—a progressive award. In this example embodiment, the gaming system has already modified the customizable bonus game to include these three features. Thereafter, the bonus triggering event occurs in association with a play of the first primary game. In this example embodiment, because the gaming system has already modified the customizable bonus game to include the three features of the first primary game, the gaming system further modifies the customizable bonus game by either increasing the value of the 3× Wild symbols to 4× Wild symbols or increasing the quantity of Wild symbols in the Wild symbol stacks (i.e., by further modifying one of the unique features of the first primary game included in the customizable bonus game). In another instance, the gaming system increases the value of any of the features of that primary game included in the customizable bonus game.

In certain embodiments, if the bonus triggering event occurs in association with a play of a wagered-on primary game, the gaming system modifies the customizable bonus game to include any feature of the wagered-on primary game not already included in the customizable bonus game.

That is, in these embodiments, the features added to the customizable bonus game do not have to be unique to the wagered-on primary game.

In certain embodiments, the gaming system may modify the customizable bonus game up to a designated quantity of times. In one such embodiment, once the gaming system has modified the customizable bonus game the designated quantity of times, the gaming system resets the customizable bonus game to its initial state. For instance, in one example embodiment in which the designated quantity is five, the gaming system has already modified the customizable bonus game four times to include the following four features: (1) 2× Wild symbols, (2) a progressive award, (3) a tumbling reels feature, and (4) 5× multiplier symbols. Thereafter, the bonus triggering event occurs in association with a play of a wagered-on primary game. Here, the gaming system: (a) modifies the customizable bonus game to include a reel re-spin feature (which is a feature included in the wagered-on primary game), (b) provides a play of the (now five-times modified) customizable bonus game, and (c) resets the customizable bonus game to its initial state by removing the five modifications (since the gaming system has now modified the customizable bonus game the designated quantity of times).

In another such embodiment, once the gaming system has modified the customizable bonus game the designated quantity of times, after each subsequent occurrence of the bonus triggering event, the gaming system modifies the customizable bonus game and removes a prior modification. In other words, in this embodiment, the gaming system replaces a previously-added feature with another feature such that the number of modifications to the customizable bonus game remains equal to the designated quantity. For instance, in one example embodiment in which the designated quantity is five, the gaming system has already modified the customizable bonus game to include the following five features: (1) 2× Wild symbols, (2) a progressive award, (3) a tumbling reels feature, (4) 5× multiplier symbols, and (5) a reel re-spin feature. Thereafter, the bonus triggering event occurs in association with a play of a wagered-on primary game. Here, the gaming system: (a) removes the 2× Wild symbols feature, and (b) adds a symbol replacement feature (which is a feature included in the wagered-on primary game). It should be appreciated that the gaming system may determine which feature to replace in any suitable manner, such as randomly, based on player selection, or according to a predetermined order (such as first-in first-out or last-in first-out).

In certain embodiments, once the gaming system has modified the customizable bonus game a designated quantity of times, the gaming system provides up to a designated quantity of plays of the customizable bonus game without further modifying the customizable bonus game. In these embodiments, after the gaming system provides the designated quantity of plays of the customizable bonus game, the gaming system resets the customizable bonus game to its initial state. For instance, in one example embodiment in which the designated quantity of times is five and the designated quantity of plays is three, the gaming system has already modified the customizable bonus game four times to include the following four features: (1) 2× Wild symbols, (2) a progressive award, (3) a tumbling reels feature, and (4) 5× multiplier symbols. Thereafter, the bonus triggering event occurs in association with a play of a wagered-on primary game. Here, the gaming system: (a) modifies the customizable bonus game to include a reel re-spin feature (which is a feature included in the wagered-on primary game), and (b) provides a play of the (now five-times modified) customizable bonus game. After the gaming system provides two more plays of the five-times modified customizable bonus game without further modifying the customizable bonus game, the gaming system resets the customizable bonus game to its initial state by removing the five modifications (since the gaming system has now provided the designated quantity of three plays of the five-times modified customizable bonus game).

In certain embodiments, the gaming system increases the average expected payback percentage of the customizable bonus game when the gaming system modifies the customizable bonus game by adding a feature to the customizable bonus game. In one such embodiment, the gaming system does so until the average expected payback percentage reaches a designated average expected payback percentage. Once the average expected payback percentage reaches the designated average expected payback percentage, the gaming system further modifies the customizable bonus game by replacing a feature with another feature to maintain the designated average expected payback percentage or by otherwise modifying the customizable bonus game after adding the new feature to maintain the designated average expected payback percentage.

In other embodiments, the gaming system maintains a designated average expected payback percentage for the customizable bonus game regardless of the features added to the customizable bonus game. Thus, in these embodiments, whenever the gaming system modifies the customizable bonus game to add a feature to the customizable bonus game, the gaming system makes additional modifications to the customizable bonus game to ensure that the average expected payback percentage of the customizable bonus game is equal to the designated average expected payback percentage.

In other embodiments, each of the primary games is associated with a standard or designated bonus game in addition to the customizable bonus game. In these embodiments, when the bonus triggering event occurs in association with a play of one of the primary games, the gaming system enables the player to choose whether to play the standard bonus game associated with that particular primary game or the customizable bonus game.

FIG. 2 illustrates a flowchart of an example process or method 200 of operating one such embodiment of the gaming system of the present disclosure. In various embodiments, the process 200 is represented by a set of instructions stored in one or more memories and executed by one or more processors. Although the process 200 is described with reference to the flowchart shown in FIG. 2, it should be appreciated that many other processes of performing the acts associated with this illustrated process 200 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, the process 200 begins when the gaming system receives a deposit of value from a player. The gaming system enables the player to wager on one of a plurality of different primary games, each of which includes a different set of one or more different features, as indicated by block 202. In other words, in this example embodiment, each of the primary games includes at least one feature that is not included in any of the sets of features of any of the other primary games. In this example embodiment, each of the primary games is also associated with a different standard bonus game that is different from the customizable bonus game. The gaming system receives a wager from the player on a play of one of the primary games, as indicated by block 204. The gaming system displays a play of the wagered-on primary game, as indicated by block 206, and displays any awards associated with the play of the wagered-on primary game, as indicated by block 208.

The gaming system determines if a bonus triggering event occurred in association with the play of the wagered-on primary game, as indicated by diamond 210. If the gaming system determines that the bonus triggering event did not occur in association with the play of the wagered-on primary game, the process 200 returns to the block 202 and again enables the player to wager on one of the plurality of different primary games. If, on the other hand, the gaming system determines that the bonus triggering event occurred in association with the play of the wagered-on primary game, the gaming system enables the player to select one of: (a) the standard bonus game associated with the wagered-on primary game, and (b) the customizable bonus game, as indicated by block 212.

The gaming system determines if a selection of the standard bonus game has been received, as indicated by diamond 214. If the gaming system determines that a selection of the standard bonus game has been received, the gaming system displays a play of the standard bonus game, as indicated by block 216. The gaming system displays any awards associated with the play of the standard bonus game, as indicated by block 218. The process 100 then returns to the block 202 and again enables the player to wager on one of the plurality of different primary games. Thus, in this example embodiment, if the gaming system receives a selection of the standard bonus game, the gaming system does not modify the standard bonus game or the customizable bonus game.

Returning to the diamond 214, if the gaming system determines that a selection of the standard bonus game has not yet been received, the gaming system determines if a selection of the customizable bonus game has been received, as indicated by diamond 220. If the gaming system determines that a selection of the customizable bonus game has not been received, the process 200 returns to the block 212, described above. If, on the other hand, the gaming system determines that a selection of the customizable bonus game has been received, the gaming system modifies the customizable bonus game to include one of the features of the wagered-on primary game that is not included in any of the sets of features of any of the other primary games, as indicated by block 222. In other words, in this example embodiment, the gaming system modifies the customizable bonus game to include a feature unique to the wagered-on primary game (with respect to at least the other primary games).

The modification of the customizable bonus game is in addition to at least one of any prior modifications of the customizable bonus game. For instance, if the gaming system previously modified the customizable bonus game to include a first feature of a first primary game and the bonus triggering event subsequently occurred in association with a play of a second different primary game, the gaming system further modifies the customizable bonus game to include a second feature of the second primary game in addition to the first feature. After modifying the customizable bonus game, the gaming system displays a play of the customizable bonus game, as indicated by block 224, and displays any awards associated with the play of the customizable bonus game, as indicated by block 226. The process 200 then returns to the block 202, and the gaming system again enables the player to wager on one of the plurality of different primary games.

FIGS. 3A, 3B, 3C, 3D, 3E, 3F, 3G, 3H, 3I, 3J, 3K, 3L, and 3M illustrate screen shots of one such example embodiment of the gaming system of the present disclosure. In this example embodiment, the gaming system enables a player to wager on and play any of five different primary games—Game 1, Game 2, Game 3, Game 4, and Game 5. As shown in Table 1 below, each of the primary games is associated with one unique feature that is not included in any of the other primary games. In this example embodiment, each of the primary games is associated with a different standard bonus game and a customizable bonus game. The customizable bonus game is a free spin bonus game associated with a set of customizable bonus game reels (described below with respect to FIG. 3F).

TABLE 1

Example Unique Features Added to Customizable Free Spin Bonus Game for Various Triggering Primary Games

| Primary Game | Unique Feature |
|---|---|
| Game 1 | 2X Wild Symbols Added to Symbol Set |
| Game 2 | Stacks of Major Symbols Added to Reels |
| Game 3 | Symbol Transformation Based on Accumulated Accumulator Symbols |
| Game 4 | Progressive Award |
| Game 5 | Tumbling Reels |

In this example embodiment, the primary games are each slot games and each include the same bonus triggering event. In this example embodiment, the bonus triggering event occurs when three Bonus symbols are displayed following a spin of the reels for a play of a wagered-on primary game. In this example embodiment, when the bonus triggering event occurs in association with a play of a wagered-on primary game, the gaming system enables the player to choose to play either the standard bonus game associated with the wagered-on primary game or the customizable bonus game, as generally described above with respect to FIG. 2.

Figure 3A:
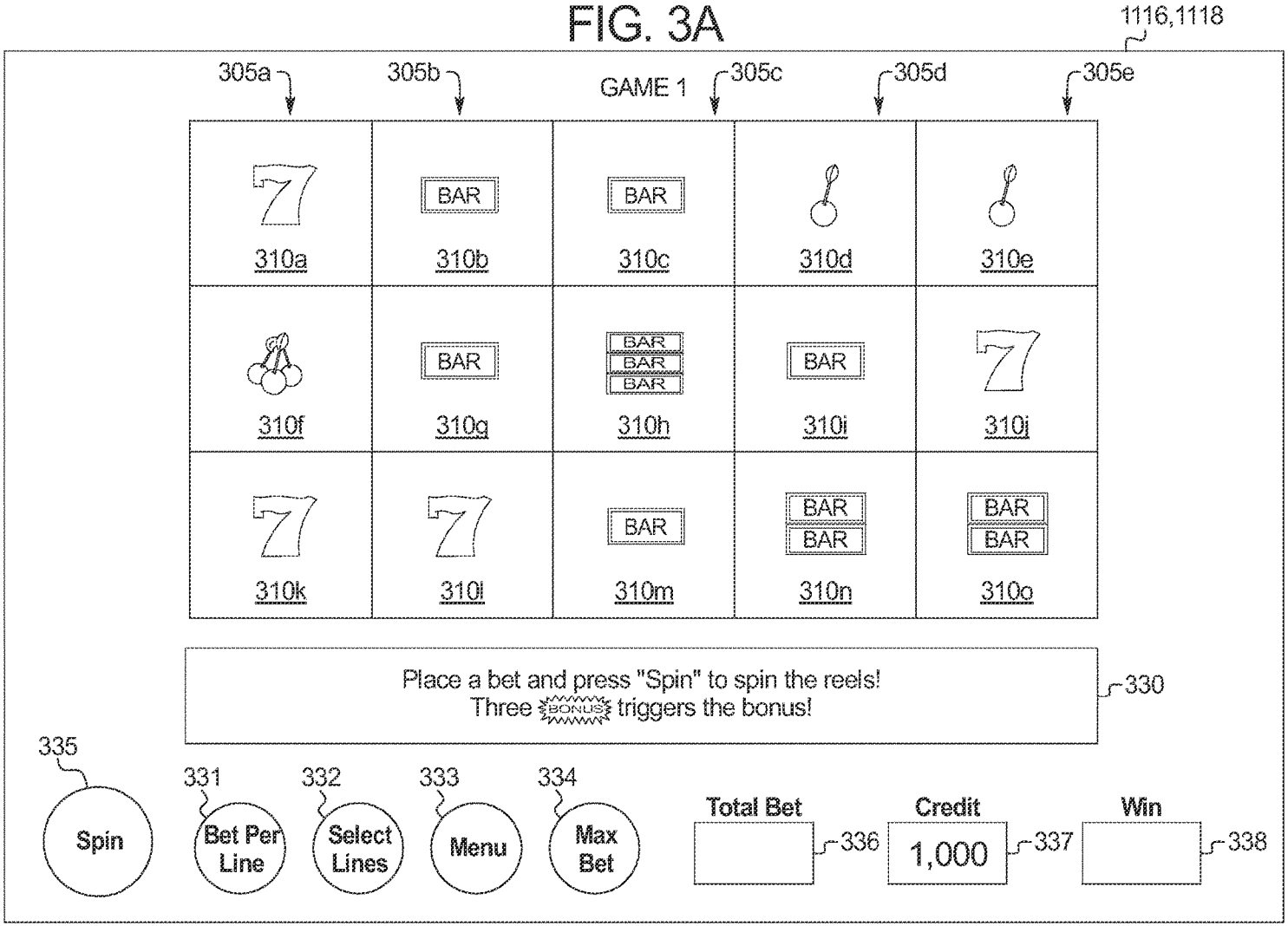
FIGS. 3A, 3B, 3C, 3D, 3E, 3F, 3G, 3H, 3I, 3J, 3K, 3L, and 3M illustrate screen shots of one example embodiment of the gaming system of the present disclosure.
Figure 3B:
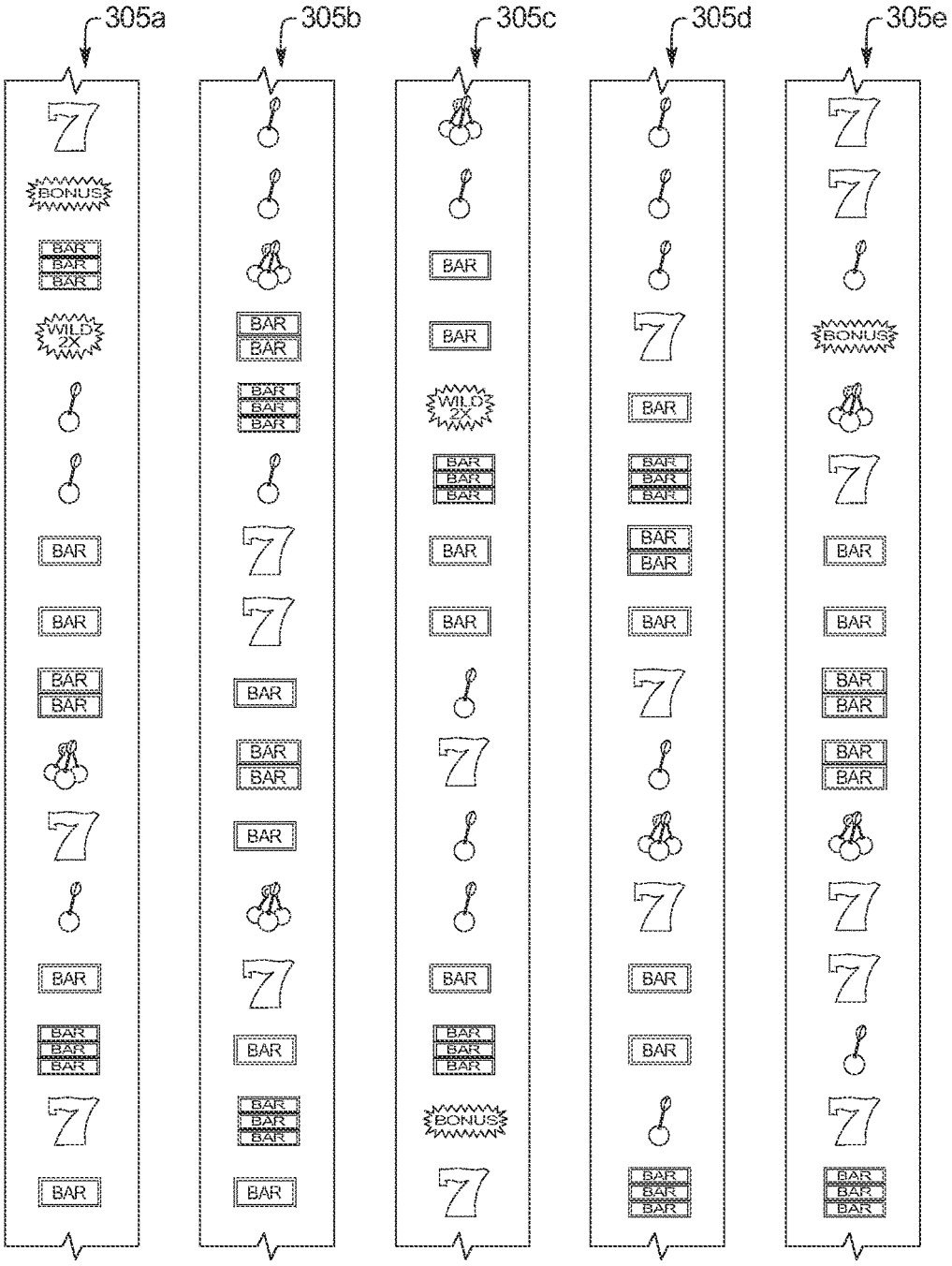

In this example embodiment, as shown in FIG. 3A, the player initially decides to play Game 1, and the gaming system displays, such as on a display device 1116 (described below), a plurality of symbol display areas 310*a*, 310*b*, 310*c*, 310*d*, 310*e*, 310*f*, 310*g*, 310*h*, 310*i*, 310*j*, 310*k*, 3101, 310*m*, 310*n*, and 310*o* arranged in a 3×5 grid or matrix. As shown in FIG. 3B, the gaming system employs a plurality of reels 305*a*, 305*b*, 305*c*, 305*d*, and 305*e* for Game 1. Each of the reels 305 includes a plurality of symbols of a set of symbols the gaming system employs for Game 1. Since Game 1 includes a 2× Wild symbol feature, certain of the reels 305 include a 2× Wild symbol. It should be appreciated that FIG. 3B illustrates only a portion of the reels 305, and that the reels 305 may include any suitable quantity and arrangement of symbols.

The gaming system displays the reels 305 in association with the symbol display areas 310. More specifically, each reel 305*a*, 305*b*, 305*c*, 305*d*, and 305*e* is associated with, and configured to display symbols at, a plurality of the symbol display areas 310. In this example embodiment: (a) the reel 305*a* is associated with, and configured to display symbols at, the symbol display areas 310*a*, 310*f*, and 310*k*; (b) the reel 305*b* is associated with, and configured to display symbols at, the symbol display areas 310*b*, 310*g*, and 310*l*; (c) the reel 305*c* is associated with, and configured to display symbols at, the symbol display areas 310*c*, 310*h*, and 310*m*; (d) the reel 305*d* is associated with, and configured to display symbols at, the symbol display areas 310*d*, 310*i*, and 310*n*; and (e) the reel 305*e* is associated with, and configured to display symbols at, the symbol display areas 310*e*, 310*j*, and 310*o*. Game 1 is associated with a plurality of paylines (not shown for clarity), each of which is associated with a different plurality of the symbol display areas.

The gaming system also displays: (a) a message box 330 that displays a variety of messages or indications before, during, or after play of Game 1; (b) a plurality of buttons actuatable by the player, including: (i) a Bet Per Line button 331 that, when actuated by the player, causes the gaming system to enable the player to select an amount to bet on each wagered-on payline; (ii) a Select Lines button 332 that, when actuated by the player, causes the gaming system to enable the player to select the paylines on which the player desires to wager for a play of Game 1; (iii) a Menu button 333 that, when actuated by the player, causes the gaming system to display additional information about Game 1, such as the paytable for Game 1 and/or the rules of Game 1; (iv) a Max Bet button 334 that, when actuated by the player, causes the gaming system to set the amount bet on each payline to a maximum amount and to set the quantity of paylines on which the player desires to wager to a maximum quantity of the paylines; and (v) a Spin button 335 that, when actuated by the player, causes the gaming system to initiate a play of Game 1; and (c) a plurality of meters including: (i) a bet meter 336 that displays any bet placed on a play of Game 1 (in credit or currency form), (ii) a credit meter 337 that displays the player's credit balance (in credit or currency form), and (iii) an award meter 338 that displays any awards won for the play of Game 1 (in credit or currency form).

Turning to FIG. 3A, the gaming system receives a deposit of value from the player and credits the player with 1,000 credits (as shown in the credit meter 337). The gaming system displays the following message in the message box 330: "PLACE A BET AND PRESS 'SPIN' TO SPIN THE REELS!THREE BONUS SYMBOLS TRIGGERS THE BONUS!"

Figure 3C:
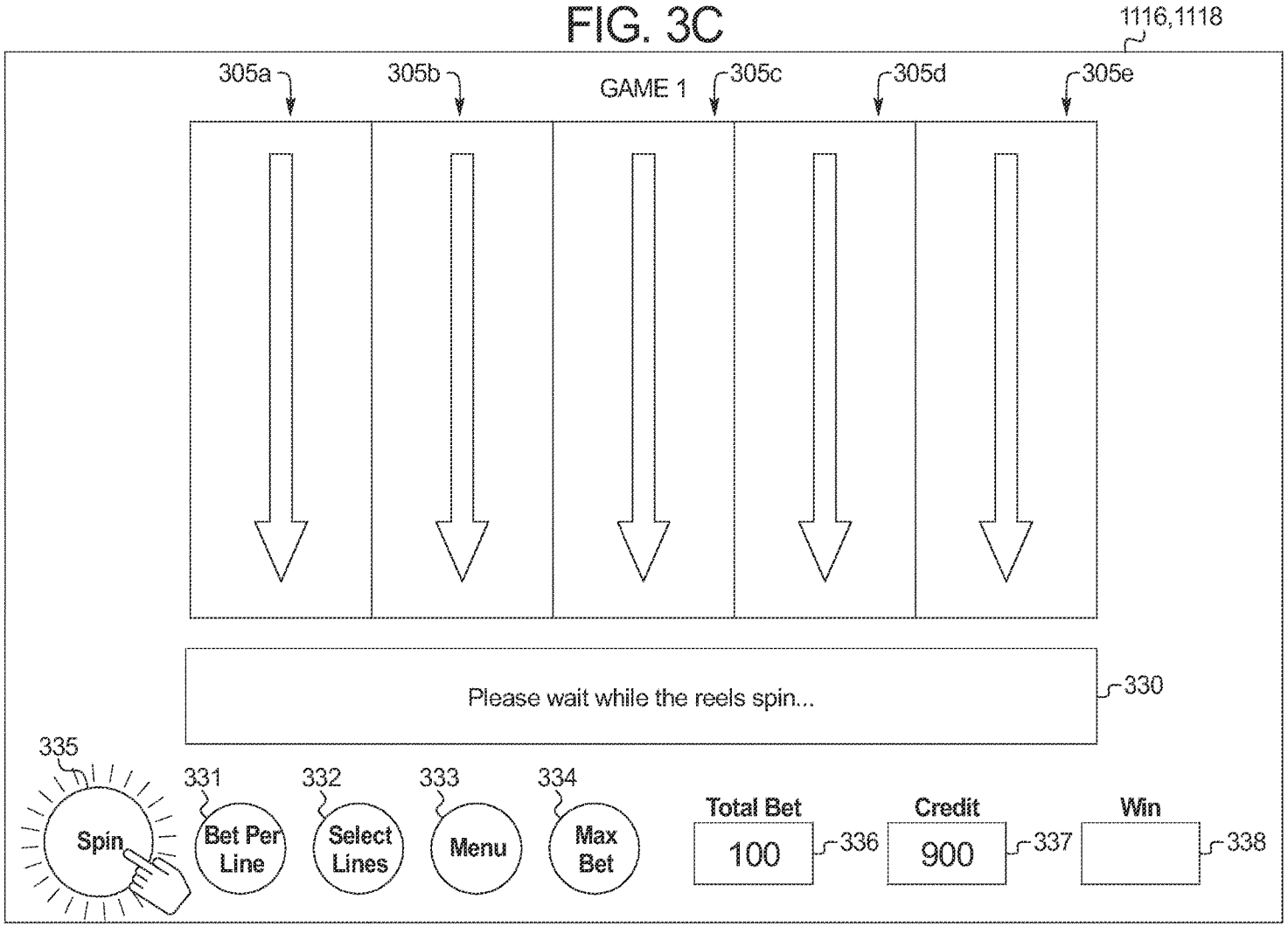

As shown in FIG. 3C, the gaming system receives a bet of 100 credits (as shown in the bet meter 336) and an actuation of the Spin button 335 from the player. Upon receiving the actuation of the Spin button 335, the gaming system reduces the player's credit balance by the 100 credit wager (as shown in the credit meter 337); initiates a play of Game 1; and displays the reels 305*a*, 305*b*, 305*c*, 305*d*, and 305*e* spinning. The gaming system displays the following message in the message box 330: "PLEASE WAIT WHILE THE REELS SPIN . . . ."

Figure 3D:
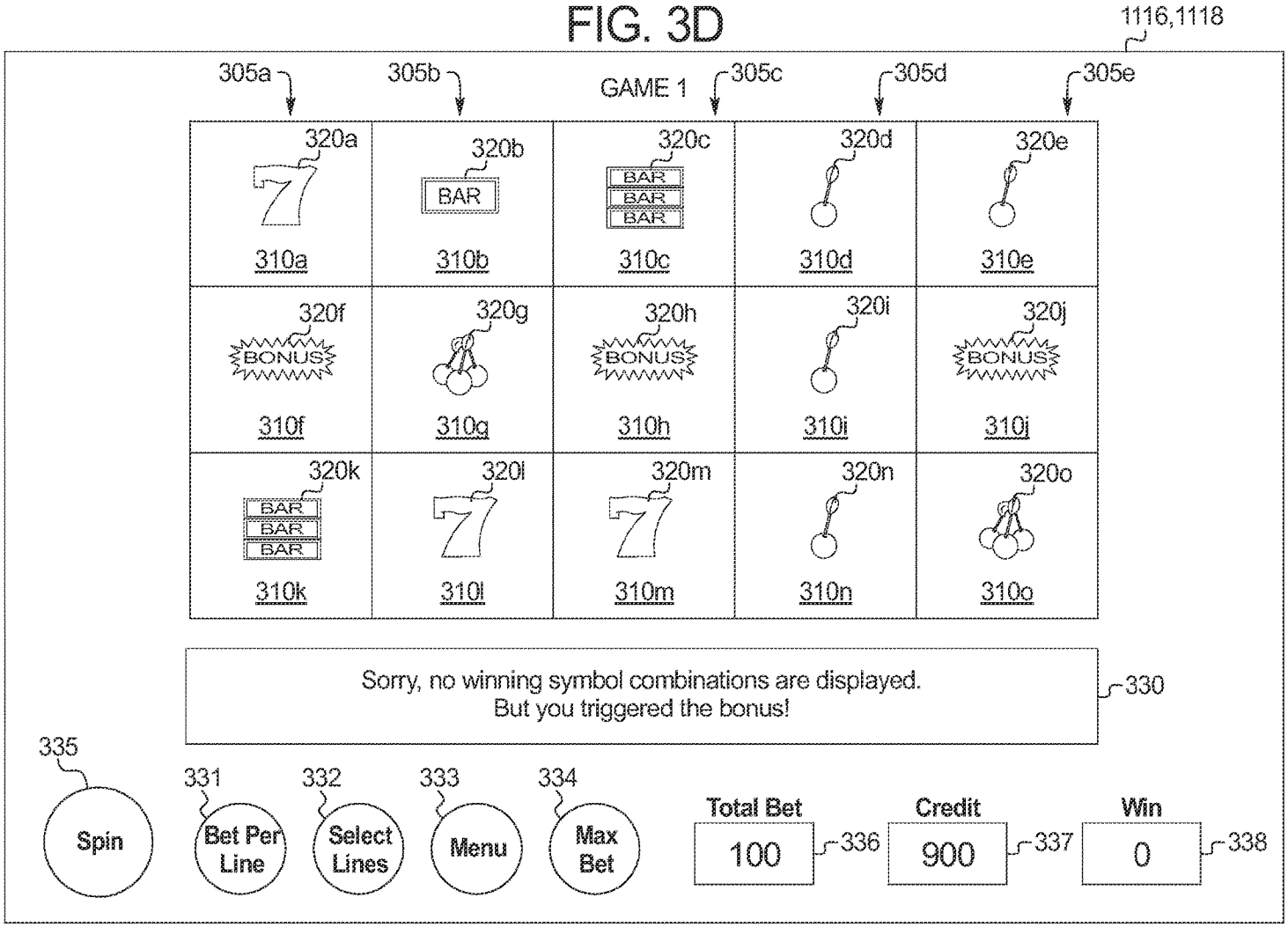

As illustrated in FIG. 3D, the gaming system stops spinning the reels 305*a*, 305*b*, 305*c*, 305*d*, and 305*e* such that: (a) Seven symbol 320*a* is displayed at the symbol display area 310*a*, (b) Bar symbol 320*b* is displayed at the symbol display area 310*b*, (c) Triple Bar symbol 320*c* is displayed at the symbol display area 310*c*, (d) Cherry symbol 320*d* is displayed at the symbol display area 310*d*, (e) Cherry symbol 320*e* is displayed at the symbol display area 310*e*, (f) Bonus symbol 320*f* is displayed at the symbol display area 310*f*, (g) Triple Cherry symbol 320*g* is displayed at the symbol display area 310*g*, (h) Bonus symbol 320*h* is displayed at the symbol display area 310*h*, (i) Cherry symbol 320*i* is displayed at the symbol display area 310*i*, (j) Bonus symbol 320*j* is displayed at the symbol display area 310*j*, (k) Triple Bar symbol 320*k* is displayed at the symbol display area 310*k*, (l) Seven symbol 320*l* is displayed at the symbol display area 310*l*, (m) Seven symbol 320*m* is displayed at the symbol display area 310*m*, (n) Cherry symbol 320*n* is displayed at the symbol display area 310*n*, and (o) Triple Cherry symbol 320*o* is displayed at the symbol display area 3100.

The gaming system determines any awards associated with the symbols displayed at the symbol display areas by determining whether any winning combinations of the symbols included in a paytable (not shown) associated with Game 1 are displayed at the symbol display areas associated with any of the wagered-on paylines (not shown). In this instance, the gaming system determines that no winning symbol combinations are displayed. The gaming system also determines whether the bonus triggering event occurred. Here, the gaming system determines that the bonus triggering event occurred because three Bonus symbols—Bonus symbol 320*f*, Bonus symbol 320*h*, and Bonus symbol 320*j*—are displayed. The gaming system displays the following message in the message box 330: "SORRY, NO WINNING SYMBOL COMBINATIONS ARE DISPLAYED. BUT YOU TRIGGERED THE BONUS!"

Figure 3E:
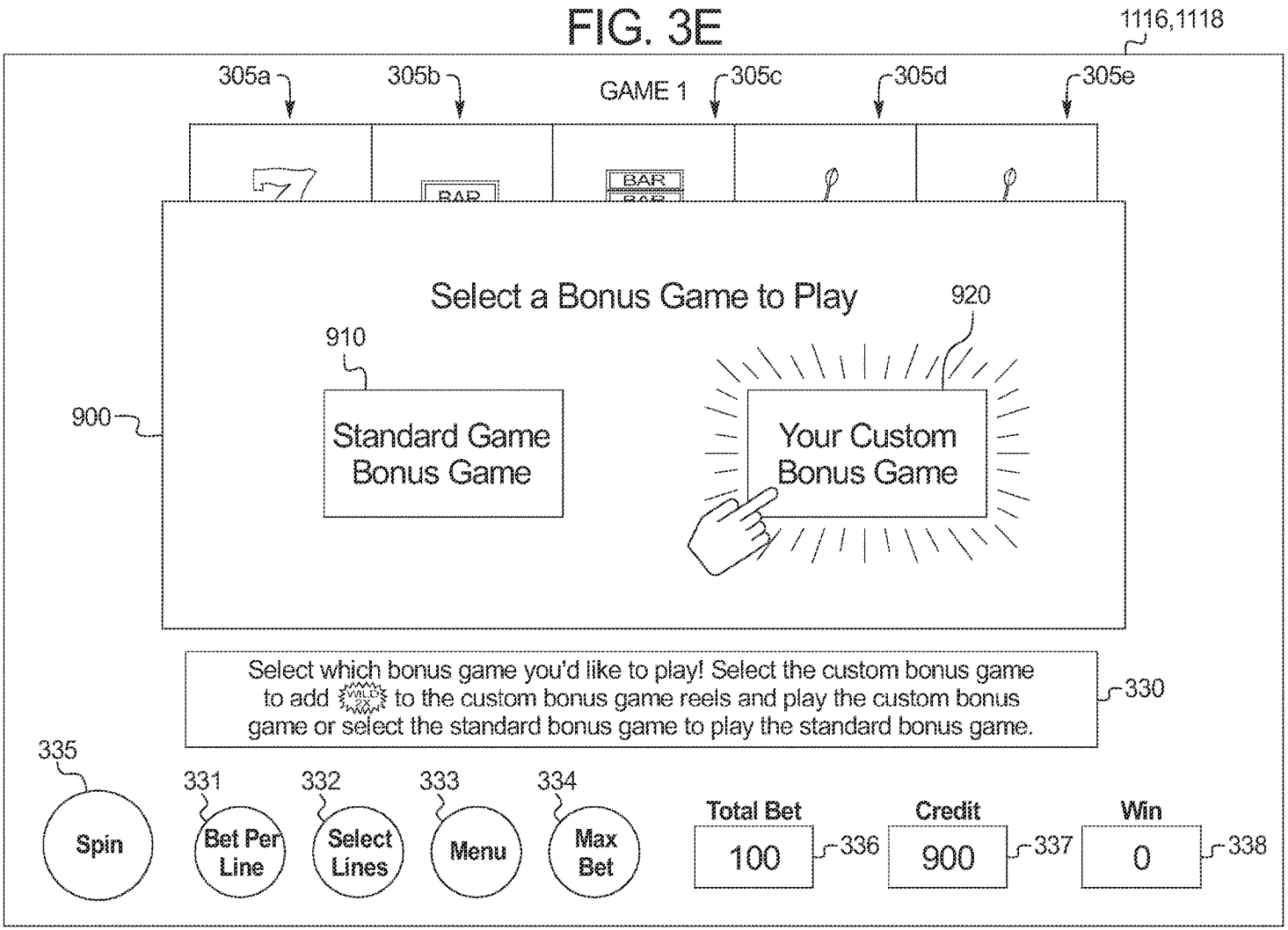

As shown in FIG. 3E, following the occurrence of the bonus triggering event, the gaming system displays a pop-up box 900 and enables the player to choose to play: (a) the standard bonus game associated with Game 1 by picking selection 910, or (b) the customizable bonus game by picking selection 920. The gaming system displays the following message in the message box 330: "SELECT WHICH BONUS GAME YOU'D LIKE TO PLAY!SELECT THE CUSTOM BONUS GAME TO ADD 2× WILD SYMBOLS TO THE CUSTOM BONUS GAME REELS AND PLAY THE CUSTOM BONUS GAME OR SELECT THE STANDARD BONUS GAME TO PLAY THE STANDARD BONUS GAME." The gaming system receives a pick of the selection 920 from the player.

Figure 3F:
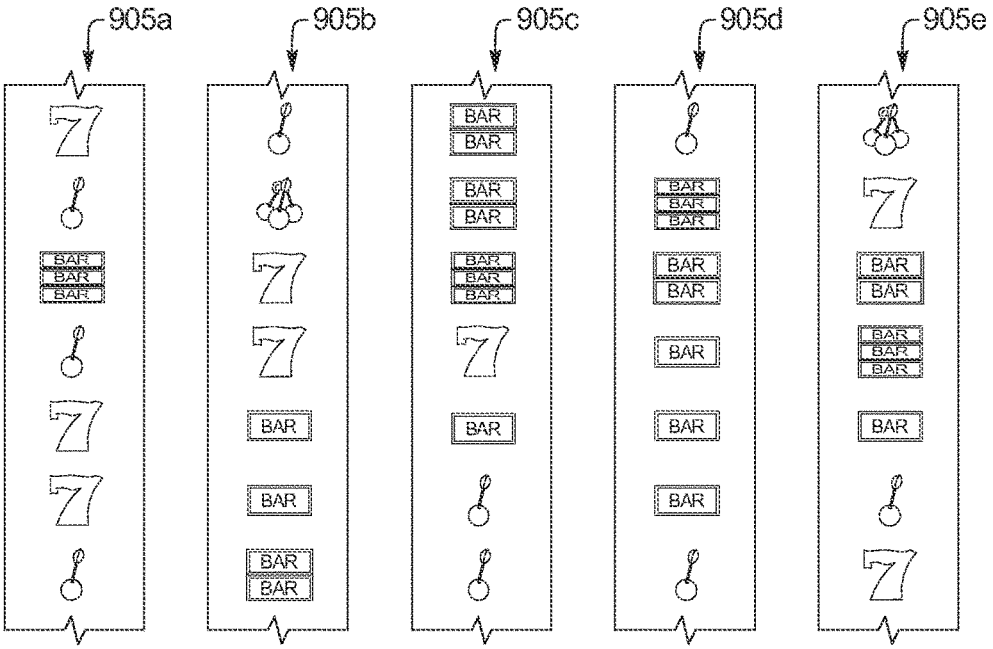
Figure 3G:
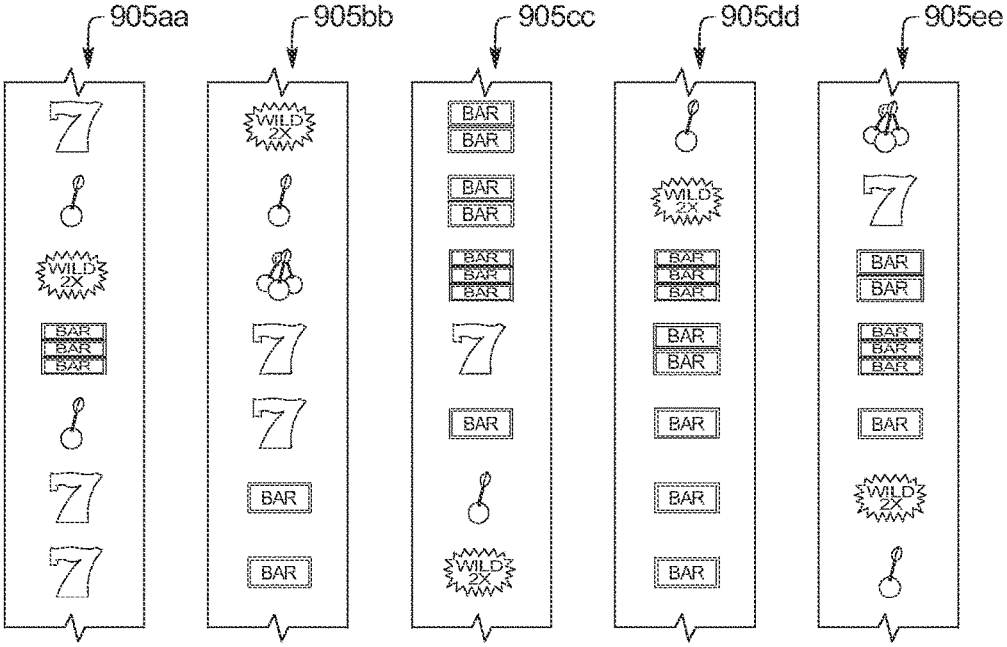

Accordingly, the gaming system modifies the customizable bonus game by adding the unique feature of Game 1 that is not included in any of Games 2, 3, 4, and 5—2× Wild symbols—to the reels of the customizable bonus game. FIG. 3F illustrates portions of the reels 905*a*, 905*b*, 905*c*, 905*d*, and 905*e* of the customizable bonus game in their initial states (i.e., before the gaming system has modified the customizable bonus game). FIG. 3G illustrates the customizable bonus game reels 905*aa*, 905*bb*, 905*cc*, 905*dd*, and 905*ee* after the gaming system has modified those reels to include the 2× Wild symbols. After modifying the reels, the gaming system provides a play of the modified customizable bonus game employing the modified reels (not shown), and provides the player any awards associated with the play of the modified customizable bonus game.

Figure 3H:
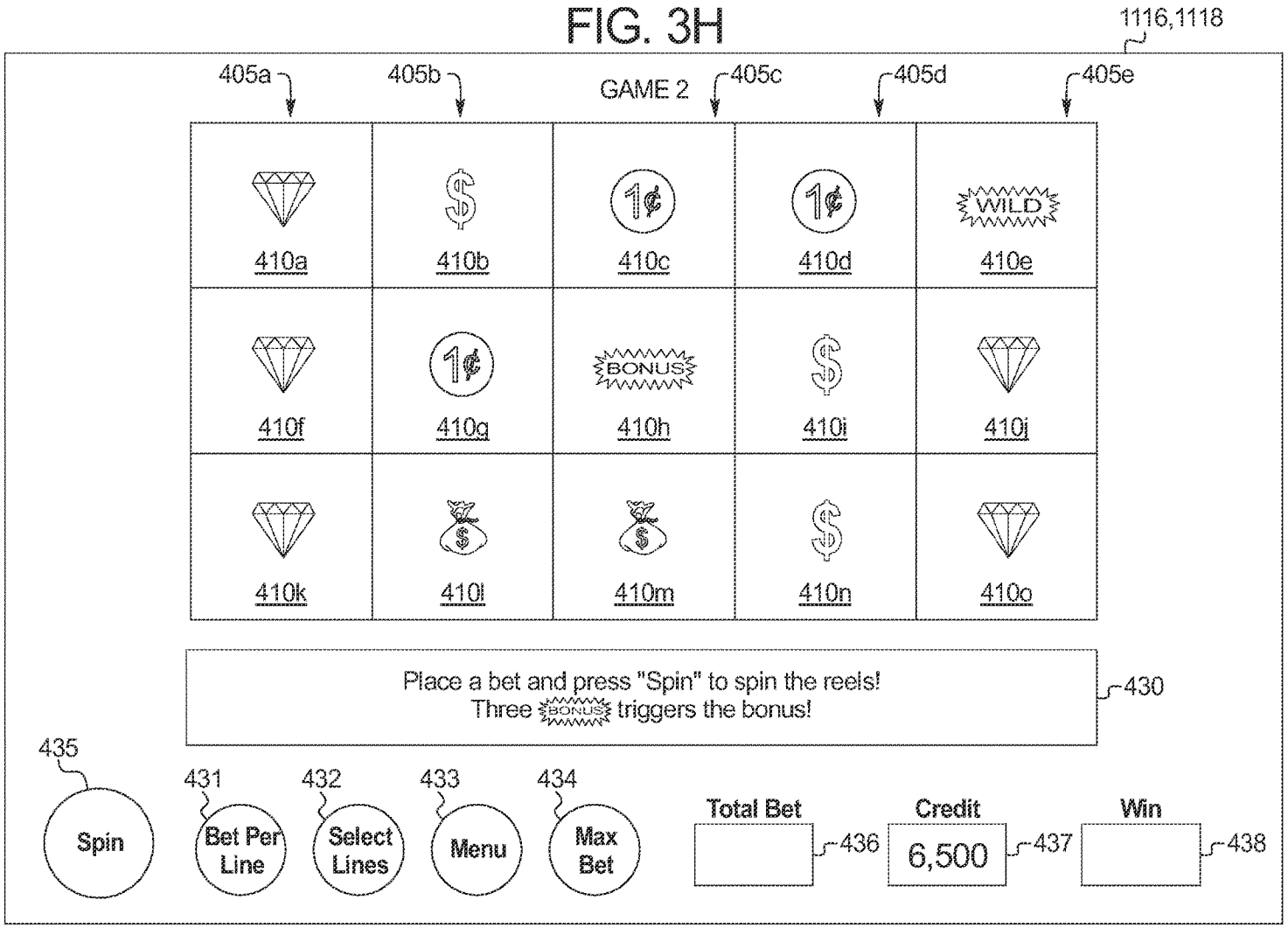
Figure 3I:
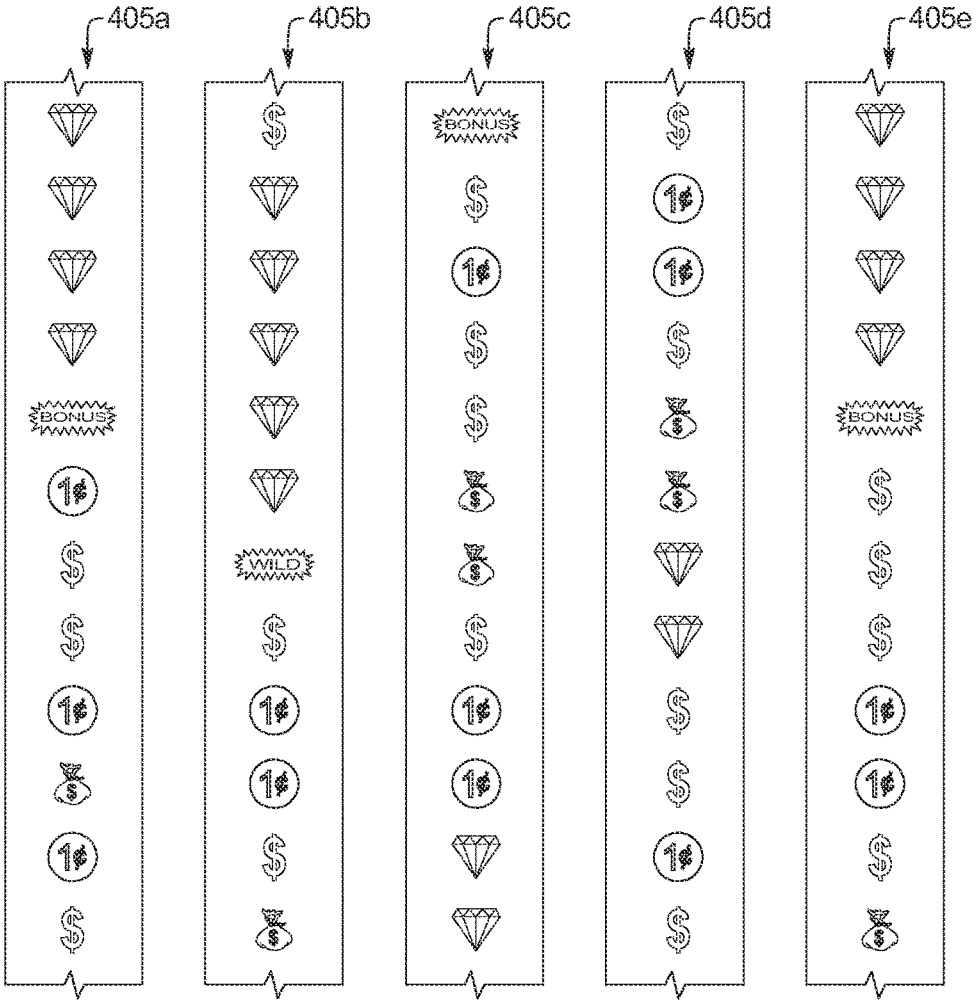

As illustrated in FIG. 3H, thereafter, the player decides to play Game 2, and the gaming system displays a plurality of symbol display areas 410*a*, 410*b*, 410*c*, 410*d*, 410*e*, 410*f*, 410*g*, 410*h*, 410*i*, 410*j*, 410*k*, 4101, 410*m*, 410*n*, and 410*o* arranged in a 3×5 grid or matrix. As shown in FIG. 3I, the gaming system employs a plurality of reels 405*a*, 405*b*, 405*c*, 405*d*, and 405*e* for Game 2. Each of the reels 405 includes a plurality of symbols of a set of symbols the gaming system employs for Game 2. Since Game 2 includes a Stacks of Major Symbols feature, certain of the reels 405 include stacks of Diamond symbols (i.e., a major symbol in this example embodiment). It should be appreciated that FIG. 3I illustrates only a portion of the reels 405, and that the reels 405 may include any suitable quantity and arrangement of symbols.

The gaming system displays the reels 405 in association with the symbol display areas 410. More specifically, each reel 405*a*, 405*b*, 405*c*, 405*d*, and 405*e* is associated with, and configured to display symbols at, a plurality of the symbol display areas 410. In this example embodiment: (a) the reel 405*a* is associated with, and configured to display symbols at, the symbol display areas 410*a*, 410*f*, and 410*k*; (b) the reel 405*b* is associated with, and configured to display symbols at, the symbol display areas 410*b*, 410*g*, and 410*l*; (c) the reel 405*c* is associated with, and configured to display symbols at, the symbol display areas 410*c*, 410*h*, and 410*m*; (d) the reel 405*d* is associated with, and configured to display symbols at, the symbol display areas 410*d*, 410*i*, and 410*n*; and (e) the reel 405*e* is associated with, and configured to display symbols at, the symbol display areas 410*e*, 410*j*, and 410*o*. Game 2 is associated with a plurality of paylines (not shown for clarity), each of which is associated with a different plurality of the symbol display areas.

The gaming system also displays: (a) a message box 430 that displays a variety of messages or indications before, during, or after play of Game 2; (b) a plurality of buttons actuatable by the player, including: (i) a Bet Per Line button 431 that, when actuated by the player, causes the gaming system to enable the player to select an amount to bet on each wagered-on payline; (ii) a Select Lines button 432 that, when actuated by the player, causes the gaming system to enable the player to select the paylines on which the player desires to wager for a play of Game 2; (iii) a Menu button 433 that, when actuated by the player, causes the gaming system to display additional information about Game 2, such as the paytable for Game 2 and/or the rules of Game 2; (iv) a Max Bet button 434 that, when actuated by the player, causes the gaming system to set the amount bet on each payline to a maximum amount and to set the quantity of paylines on which the player desires to wager to a maximum quantity of the paylines; and (v) a Spin button 435 that, when actuated by the player, causes the gaming system to initiate a play of Game 2; and (c) a plurality of meters including: (i) a bet meter 436 that displays any bet placed on a play of Game 2 (in credit or currency form), (ii) a credit meter 437 that displays the player's credit balance (in credit or currency form), and (iii) an award meter 438 that displays any awards won for the play of Game 2 (in credit or currency form).

Turning to FIG. 3H, the gaming system receives a deposit of value from the player and credits the player with 6,500 credits (as shown in the credit meter 437). The gaming system displays the following message in the message box 430: "PLACE A BET AND PRESS 'SPIN' TO SPIN THE REELS!THREE BONUS SYMBOLS TRIGGERS THE BONUS!"

Figure 3J:
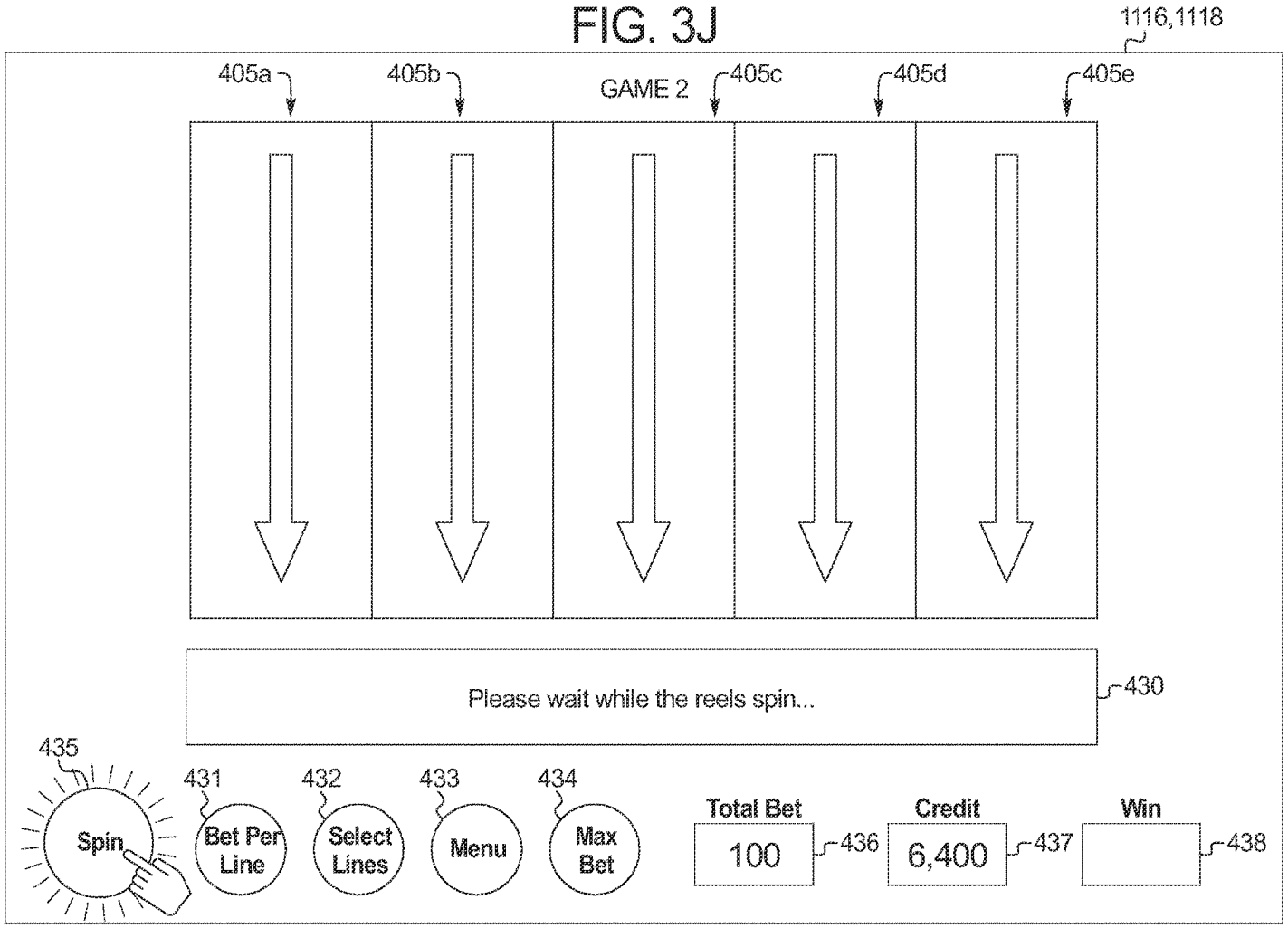

As shown in FIG. 3J, the gaming system receives a bet of 100 credits (as shown in the bet meter 436) and an actuation of the Spin button 435 from the player. Upon receiving the actuation of the Spin button 435, the gaming system reduces the player's credit balance by the 100 credit wager (as shown in the credit meter 437); initiates a play of Game 2; and displays the reels 405*a*, 405*b*, 405*c*, 405*d*, and 405*e* spinning. The gaming system displays the following message in the message box 430: "PLEASE WAIT WHILE THE REELS SPIN . . . ."

Figure 3K:
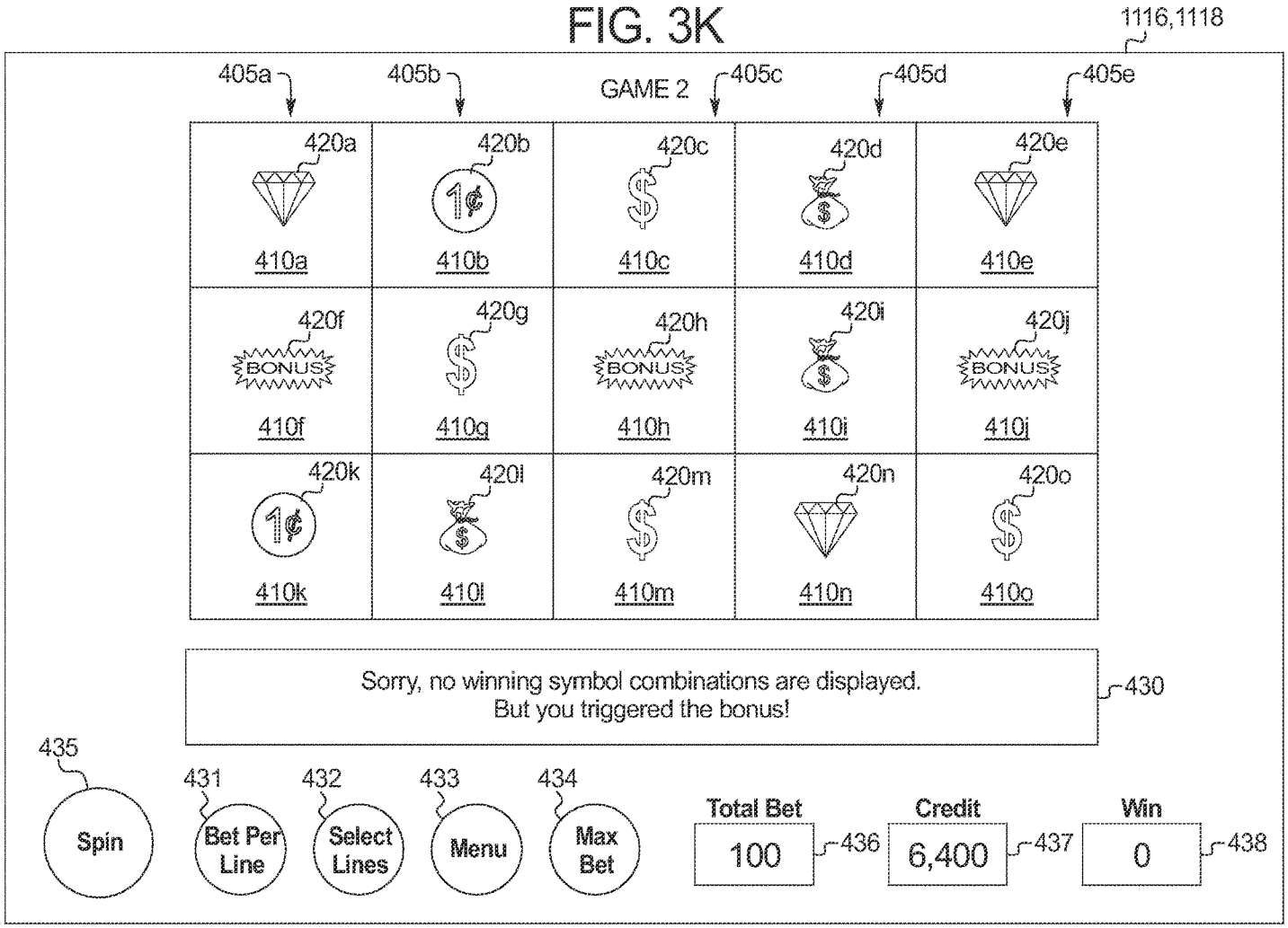

As illustrated in FIG. 3K, the gaming system stops spinning the reels 405*a*, 405*b*, 405*c*, 405*d*, and 405*e* such that: (a) Diamond symbol 420*a* is displayed at the symbol display area 410*a*, (b) Coin symbol 420*b* is displayed at the symbol display area 410*b*, (c) Dollar Sign symbol 420*c* is displayed at the symbol display area 410*c*, (d) Money Bag symbol 420*d* is displayed at the symbol display area 410*d*, (e) Diamond symbol 420*e* is displayed at the symbol display area 410*e*, (f) Bonus symbol 420*f* is displayed at the symbol display area 410*f*, (g) Dollar Sign symbol 420*g* is displayed at the symbol display area 410*g*, (h) Bonus symbol 420*h* is displayed at the symbol display area 410*h*, (i) Money Bag symbol 420*i* is displayed at the symbol display area 410*i*, (j) Bonus symbol 420*j* is displayed at the symbol display area 410*j*, (k) Coin symbol 420*k* is displayed at the symbol display area 410*k*, (l) Money Bag symbol 420*l* is displayed at the symbol display area 410*l*, (m) Dollar Sign symbol 420*m* is displayed at the symbol display area 410*m*, (n) Diamond symbol 420*n* is displayed at the symbol display area 410*n*, and (o) Dollar Sign symbol 4200 is displayed at the symbol display area 410*o*.

The gaming system determines any awards associated with the symbols displayed at the symbol display areas by determining whether any winning combinations of the symbols included in a paytable (not shown) associated with Game 2 are displayed at the symbol display areas associated with any of the wagered-on paylines (not shown). In this instance, the gaming system determines that no winning symbol combinations are displayed. The gaming system also determines whether the bonus triggering event occurred. Here, the gaming system determines that the bonus triggering event occurred because three Bonus symbols—Bonus symbol 420*f*, Bonus symbol 420*h*, and Bonus symbol 420*j*—are displayed. The gaming system displays the following message in the message box 430: "SORRY, NO WINNING SYMBOL COMBINATIONS ARE DISPLAYED. BUT YOU TRIGGERED THE BONUS!"

Figure 3L:
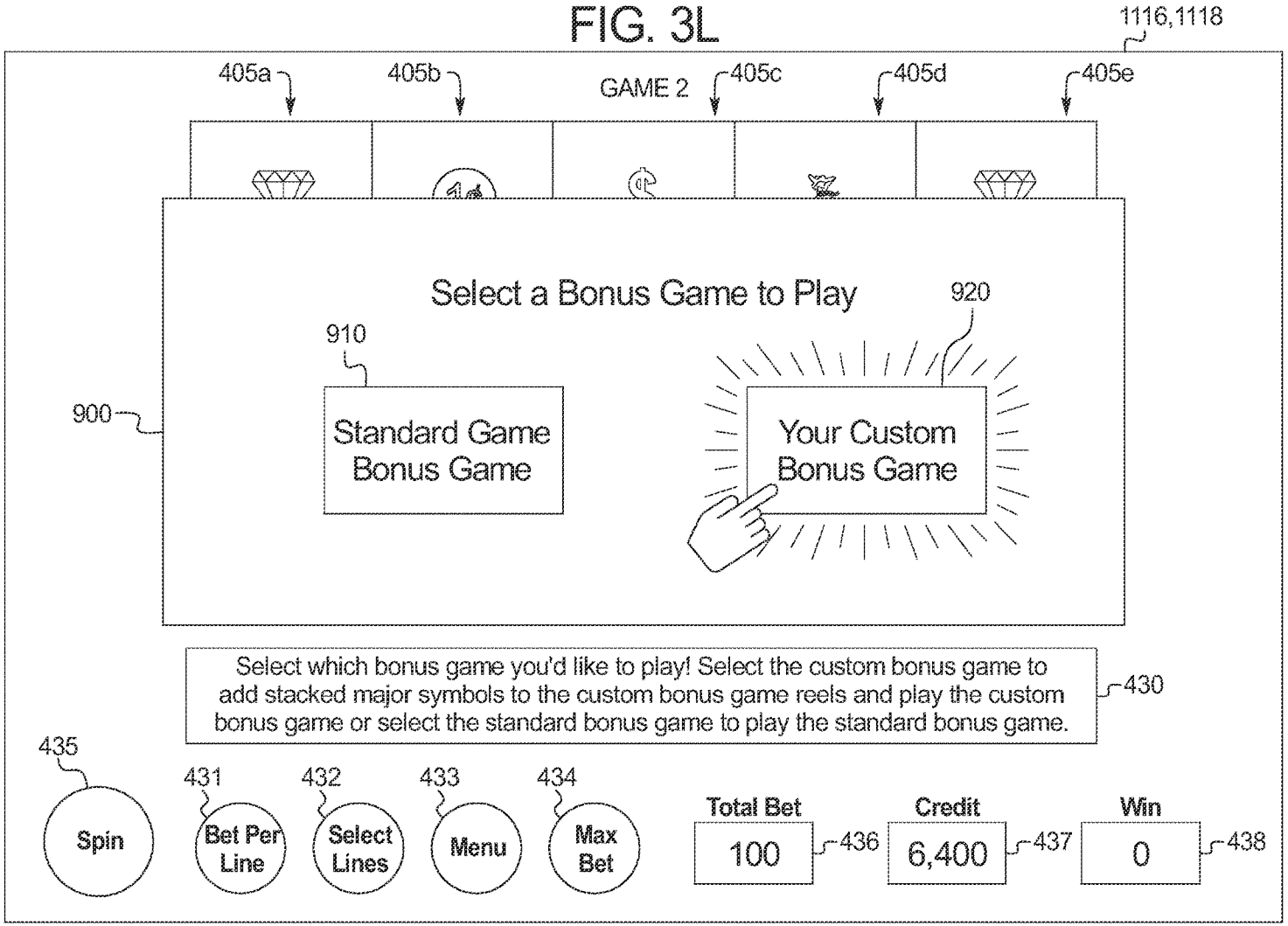

As shown in FIG. 3L, following the occurrence of the bonus triggering event, the gaming system displays the pop-up box 900 and enables the player to choose to play: (a) the standard bonus game associated with Game 2 by picking selection 910, or (b) the customizable bonus game by picking selection 920. The gaming system displays the following message in the message box 430: "SELECT WHICH BONUS GAME YOU'D LIKE TO PLAY!SELECT THE CUSTOM BONUS GAME TO ADD STACKED MAJOR SYMBOLS TO THE CUSTOM BONUS GAME REELS AND PLAY THE CUSTOM BONUS GAME OR SELECT THE STANDARD BONUS GAME TO PLAY THE STANDARD BONUS GAME." The gaming system receives a pick of the selection 920 from the player.

Figure 3M:
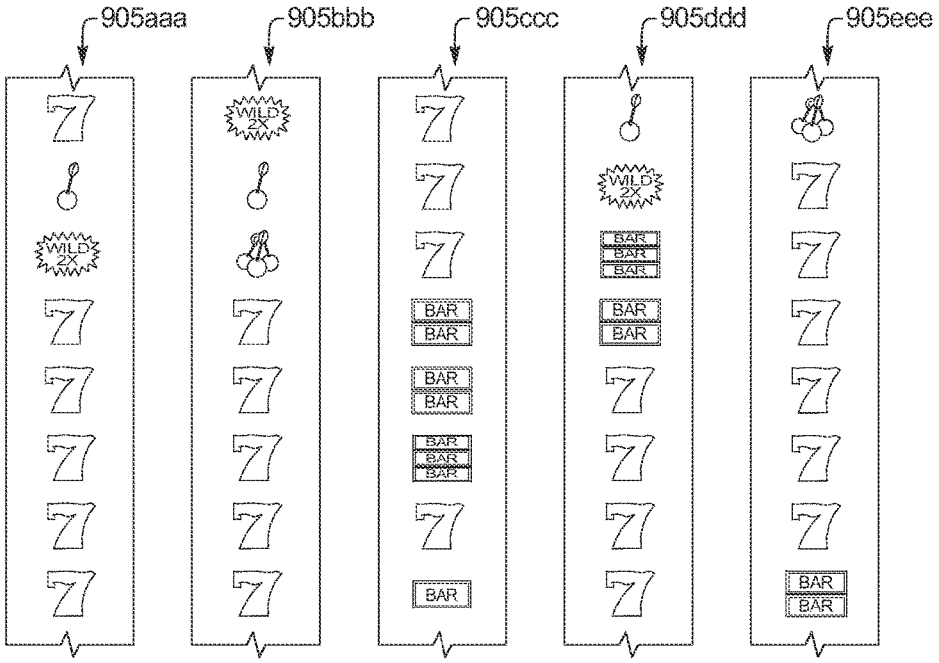

Accordingly, the gaming system modifies the customizable bonus game by adding the unique feature of Game 2 that is not included in any of Games 1, 3, 4, and 5—Stacks of Major Symbols—to the reels of the customizable bonus game in addition to the above-described prior modification. FIG. 3M illustrates the customizable bonus game reels 905*aaa*, 905*bbb*, 905*ccc*, 905*ddd*, and 905*eee* after the gaming system has modified those reels to include stacks of Seven symbols (i.e., major symbols in this example embodiment). After modifying the reels, the gaming system provides a play of the modified customizable bonus game employing the modified reels (not shown), and provides the player any awards associated with the play of the modified customizable bonus game.

Figure 4A:
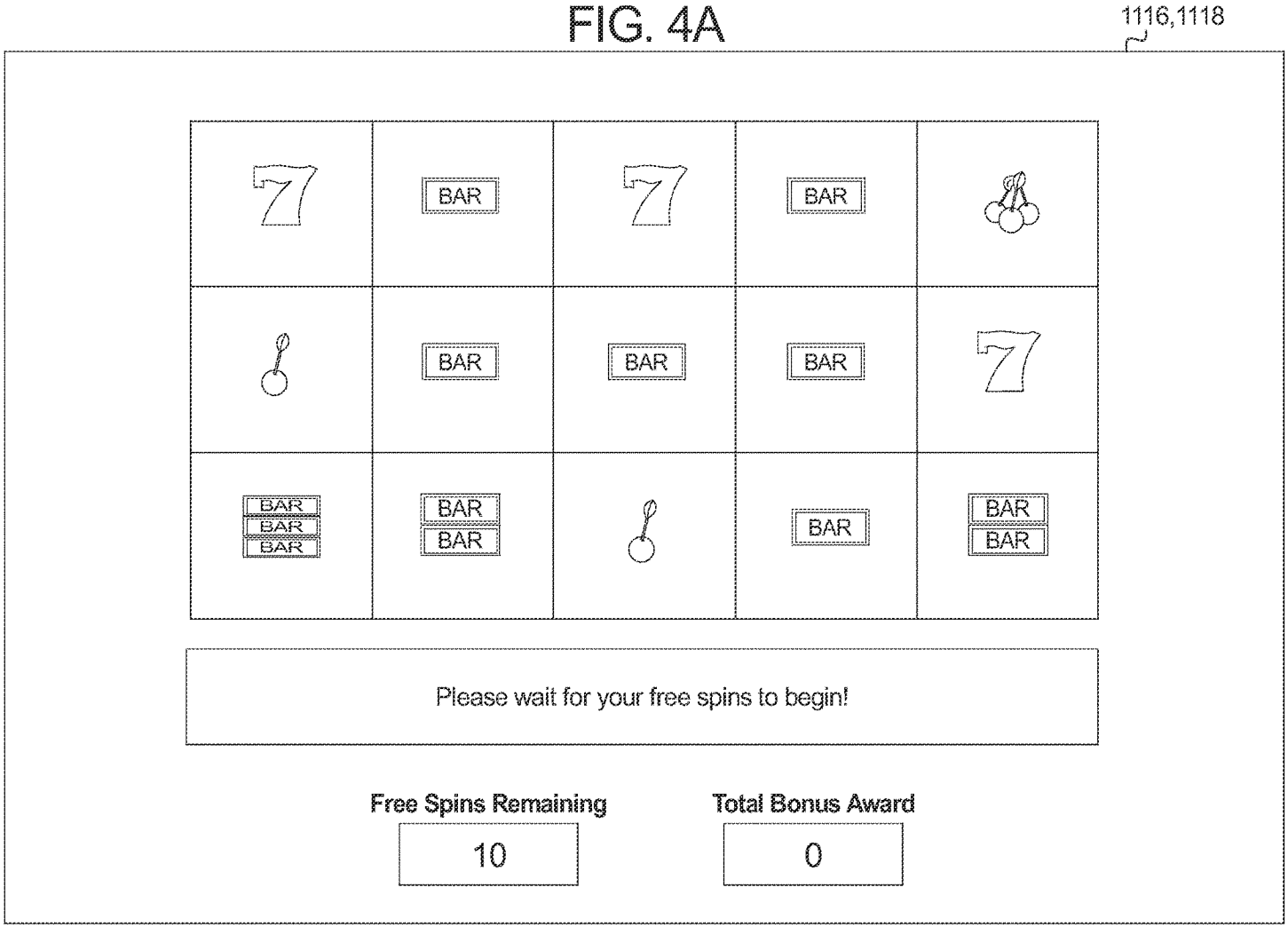
FIGS. 4A and 4B illustrate screen shots of another example embodiment of the gaming system of the present disclosure displaying a play of the customizable bonus game before any modifications are made to the customizable bonus game and after four modifications are made to the customizable bonus game, respectively.
Figure 4B:
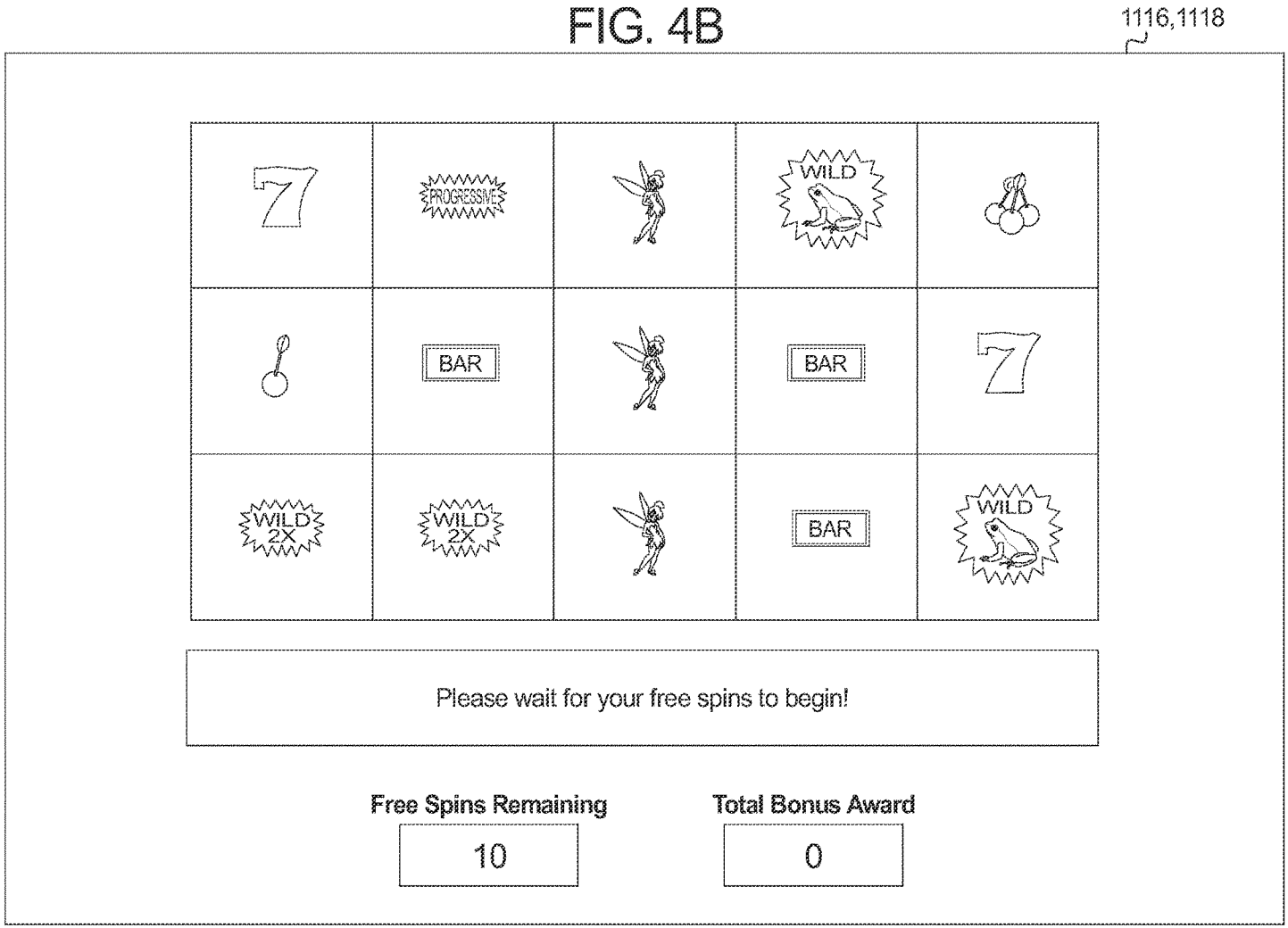

FIGS. 4A and 4B illustrate screen shots of another example embodiment of the gaming system displaying a play of the customizable bonus game before and after any modifications are made to the bonus game, respectively. More specifically, FIG. 4A illustrates a screen shot of the gaming system upon triggering the customizable bonus game, but before any modifications are made to the customizable bonus game. FIG. 4B illustrates a screen show of the gaming system upon a subsequent trigger of the customizable bonus game after the gaming system has made the following four modifications: (1) added 2× Wild symbols to certain of the customizable bonus game reels, which is a feature included in a first primary game; (2) added a progressive award feature, which is a feature included in a second different primary game; (3) added a stack of transforming fairy symbols to certain of the customizable bonus game reels, which is a feature included in a third different primary game; and (4) added an expanding Wild Frog symbol to certain of the customizable bonus game reels, which is a feature included in a fourth different primary game.

In various embodiments, a separate, individual customizable bonus game is associated with each particular player. In these embodiments, the customizable bonus game of a particular player cannot be modified based on game play of any other players. In other embodiments, however, the customizable bonus game is associated with a plurality of players, and the gaming system may modify the customizable bonus game based on game play of any of those players. For instance, in one example embodiment, a group of players shares the same customizable bonus game. In this example embodiment, the gaming system modifies the customizable bonus game whenever any of the players triggers the customizable bonus game. In further embodiments, the customizable bonus game is associated with a plurality of EGMs, such as the EGMs of a particular bank of EGMs, and the gaming system may modify the customizable bonus game in association with game play of any of those EGMs. For instance, in one example embodiment, a bank of ten EGMs at a gaming establishment shares the same customizable bonus game. In this example embodiment, the gaming system modifies the customizable bonus game whenever any of the players of any of the EGMs triggers the customizable bonus game.

In certain embodiments, the gaming system does not modify the customizable bonus game in addition to at least one of any prior modifications of the customizable bonus game. In these embodiments, if the gaming system triggers the customizable bonus game and the gaming system has previously modified the customizable bonus game to include a feature, the gaming system replaces that feature with a feature of the wagered-on primary game that triggered the customizable bonus game. Thus, in these embodiments, the gaming system modifies the customizable bonus game such that the customizable bonus game only includes a feature of the wagered-on primary game that triggered the customizable bonus game. For instance, in one example embodiment, a player triggers the customizable bonus game during play of a first primary game. Accordingly, the gaming system modifies the customizable bonus game to include a unique feature of the first primary game—2× Wild symbols—and provides a play of the modified customizable bonus game. Subsequently, the player triggers the customizable bonus game during play of a second primary game. Accordingly, the gaming system modifies the customizable bonus game by replacing the 2× Wild symbols with a tumbling reels feature, which is unique to the second primary game, and provides a play of the modified customizable bonus game.

The customizable bonus game may be any suitable type of game. In one embodiment, the customizable bonus game is a selection game. Table 2 below describes how the gaming system modifies the customizable selection bonus game to include various features of the primary games.

TABLE 2

Example Unique Features Added to Customizable Selection Bonus Game for Various Triggering Primary Games

| Triggering Primary Game | Unique Feature |
|---|---|
| Game 1 | Award Associated with First Pick Multiplied by 2X |
| Game 2 | Tumbling Selections |
| Game 3 | Additional Picks Based on Accumulated Accumulator Selections |
| Game 4 | Progressive Award |
| Game 5 | Certain Selections Associated with Stacked Awards |

In other embodiments, the customizable bonus game is a battle or fight-type bonus game in which two or more characters battle or fight one another. In one such embodiment, the gaming system chooses the characters based on the wagered-on primary game that triggered the customizable bonus game and/or at least one prior wagered-on primary game that triggered the customizable bonus game. For instance, when the customizable bonus game is triggered in association with a play of a wagered-on primary game, the gaming system chooses at least one character that is associated with the wagered-on primary game for the customizable bonus game. In certain embodiments, a particular primary game is associated with a plurality of different characters or a plurality of different versions of the same character. It should be appreciated that the gaming system may select the particular character in any suitable manner, such as randomly or based on player selection.

In one such embodiment, the battle or fight-type bonus is "fought" using one or more of the features of the primary games. For instance, in one example embodiment, tumbling reels symbols may explode based on certain combination matches to cause damage to an opponent or a player may collect accumulator symbols to cause damage to an opponent.

In further embodiments, the customizable bonus game is a path-type game. In one such embodiment, the gaming system determines the player's player piece for the path game based on the wagered-on primary game that triggered the customizable bonus game. In another such embodiment, the gaming system populates spots along the path with awards based on the wagered-on primary game that triggered the customizable bonus game. For instance, in one example embodiment in which the bonus triggering event occurred in association with a play of a first game having a 2× multiplier symbol, the gaming system ass 2× multipliers to each spot along the path.

In various embodiments, when the gaming system modifies the customizable bonus game to include one of the features of the primary game that triggered the customizable bonus game, the gaming system does not carry that particular modification forward to subsequent plays of the customizable bonus game unless a modification retention event occurs during the play of the customizable bonus game. Put differently, when the customizable bonus game is triggered in association with a play of a wagered-on primary game, the gaming system: (a) modifies the customizable bonus game to include a feature of the wagered-on primary game; (b) provides a play of the modified bonus game; and (c) thereafter, removes that feature from the customizable bonus game unless a modification retention event occurs during the play of the customizable bonus game. For instance, in one example embodiment, the bonus triggering event occurs in association with a play of a first primary game. The gaming system modifies the customizable bonus event to include a tumbling reels feature, which is a feature of the first primary game, and provides a play of the customizable bonus game. Since the modification retention event did not occur during the play of the customizable bonus game, the gaming system removes the tumbling reels feature from the customizable bonus game.

In other embodiments, the modification retention event applies to all features rather than individual ones. Put differently, when the customizable bonus game is triggered in association with a play of a wagered-on primary game, the gaming system: (a) modifies the customizable bonus game to include a feature of the wagered-on primary game, (b) provides a play of the modified bonus game; and (c) thereafter, removes any features from the customizable bonus game unless a modification retention event occurs during the play of the customizable bonus game. For instance, in one example embodiment, the bonus triggering event occurs in association with a play of a first primary game. The gaming system modifies the customizable bonus game, which already includes a 2× Wild symbols feature and a stacked major symbols feature, to include a tumbling reels feature, which is a feature of the first primary game, and provides a play of the customizable bonus game. Since the modification retention event did not occur during the play of the customizable bonus game, the gaming system removes all three features from the customizable bonus game.

The present disclosure contemplates an embodiment in which the customizable bonus game is associated with a single primary game. In one such embodiment, the gaming system enables the player to play a primary game that is associated with a first bonus game and a second bonus game. In this example embodiment, if a modification retention event occurs, the gaming system modifies at least one of the first bonus game and the second bonus game such that the gaming system provides the modified version of the first bonus game and/or the second bonus game the next time the first bonus game and/or the second bonus game is/are triggered.

In one such embodiment, if the modification retention event occurs during play of the first bonus game or the second bonus game, the gaming system modifies whichever bonus game is triggered next. For instance, in one example embodiment, the primary game is a slot game associated with a fire bonus game and an ice bonus game. In this example embodiment, if the modification retention event occurs during play of the fire bonus game and the fire bonus game is the next-triggered bonus game, the gaming system modifies the fire bonus game by making all fire symbols 2× Wild symbols. If instead the ice bonus game is the next-triggered bonus game, the gaming system modifies the ice bonus game by making all fire symbols Wild symbols. If the modification retention event occurs during play of the ice bonus game and the ice bonus game is the next-triggered bonus game, the gaming system modifies the ice bonus game by making all ice symbols 2× Wild symbols. If instead the fire bonus game is the next-triggered bonus game, the gaming system modifies the fire bonus game by making all ice symbols Wild symbols.

In certain embodiments, each wager level is associated with its own customizable bonus game. In certain such embodiments, for a given player, a different customizable bonus game is associated with each wager level for that player. For instance, in one example embodiment, a player is associated with: (a) a first customizable bonus game associated with a $0.01 wager level, (b) a second customizable bonus game associated with a $0.02 wager level, (c) a third customizable bonus game associated with a $0.05 wager level, (d) a fourth customizable bonus game associated with a $0.25 wager level, and (e) a fifth customizable bonus game associated with a $1.00 wager level. In these embodiments, when the bonus triggering event occurs in association with a play of a wagered-on primary game, the gaming system modifies the customizable bonus game associated with the wager level at which the player wagered on the wagered-on primary game. In other embodiments, such as embodiments in which the average expected payback percentage of the customizable bonus game does not change as the customizable bonus game is modified, each player is associated with a single customizable bonus game, regardless of the wager level at which the player plays.

In certain embodiments in which each of the primary games is associated with a standard or designated bonus game in addition to the customizable bonus game, each primary game is associated with a standard bonus game triggering event and a customizable bonus game triggering event. In these embodiments, the gaming system provides a play of the standard bonus game upon an occurrence of the standard bonus game triggering event in association with a play of one of the primary games and modifies and provides a play of the customizable bonus game upon an occurrence of the customizable bonus game triggering event in association with a play of one of the primary games. Thus, in these embodiments, the gaming system does not enable the player to choose which bonus game to play.

In other embodiments in which each of the primary games is associated with a standard or designated bonus game in addition to the customizable bonus game, when the bonus triggering event occurs in association with a play of one of the primary games, the gaming system determines (such as randomly or based on any other suitable factor besides player selection) whether to provide the standard bonus game associated with that particular primary game or the customizable bonus game.

In other embodiments in which each of the primary games is associated with a standard or designated bonus game in addition to the customizable bonus game, when the bonus triggering event occurs in association with a play of one of the primary games and the gaming system receives a selection of the customizable bonus game, the gaming system modifies the customizable bonus game to include one of: (a) one of the features of the set of features of the wagered-on primary game that is not included in any of the sets of features of any of the other primary games, and (b) one of the features of a set of one or more features of the standard bonus game associated with the wagered-on primary game that is not included in any of the other standard bonus games.

In other embodiments in which each of the primary games is associated with a standard or designated bonus game in addition to the customizable bonus game, when the bonus triggering event occurs in association with a play of one of the primary games and the gaming system receives a selection of the customizable bonus game, the gaming system modifies the customizable bonus game to include one of one of the features of a set of one or more features of the standard bonus game associated with the wagered-on primary game that is not included in any of the other standard bonus games.

In other embodiments in which each of the primary games is associated with a standard or designated bonus game in addition to the customizable bonus game, when the bonus triggering event occurs in association with a play of one of the primary games and the gaming system receives a selection of the customizable bonus game, the gaming system modifies the customizable bonus game to include one of: (a) one of the features of the set of features of the wagered-on primary game, and (b) one of the features of a set of one or more features of the standard bonus game associated with the wagered-on primary game.

In other embodiments in which each of the primary games is associated with a standard or designated bonus game in addition to the customizable bonus game, when the bonus triggering event occurs in association with a play of one of the primary games and the gaming system receives a selection of the customizable bonus game, the gaming system modifies the customizable bonus game to include one of one of the features of a set of one or more features of the standard bonus game associated with the wagered-on primary game.

The present disclosure contemplates enabling the player to overlappingly play a plurality of the primary games in a multiplay environment. In certain such embodiments, when the bonus triggering event occurs in association with a play of one of the overlappingly-played primary games, the gaming system modifies the customizable bonus game to include one of the features of the primary game in which the bonus triggering event occurred that is not included in any of the other primary games. In other such embodiments, when the bonus triggering event occurs in association with a play of one of the overlappingly-played primary games, the gaming system modifies the customizable bonus game to include one of the features of the primary game in which the bonus triggering event occurred that is not included in any of the other primary games that are not being overlappingly played, but that may be included in at least one other overlappingly-played primary game.

It should be appreciated that:

(a) the bonus triggering event;
(b) the particular primary games associated with the customizable bonus game;
(c) the type of customizable bonus game;
(d) the feature(s) of the primary games;
(e) the unique feature(s) of the primary games;
(f) the determination of which feature of the wagered-on primary game to add to the customizable bonus game;
(g) the designated quantity of modifications (if any);
(h) the modification retention event;
(i) which feature to replace with another feature; and/or
(j) any other variables and determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
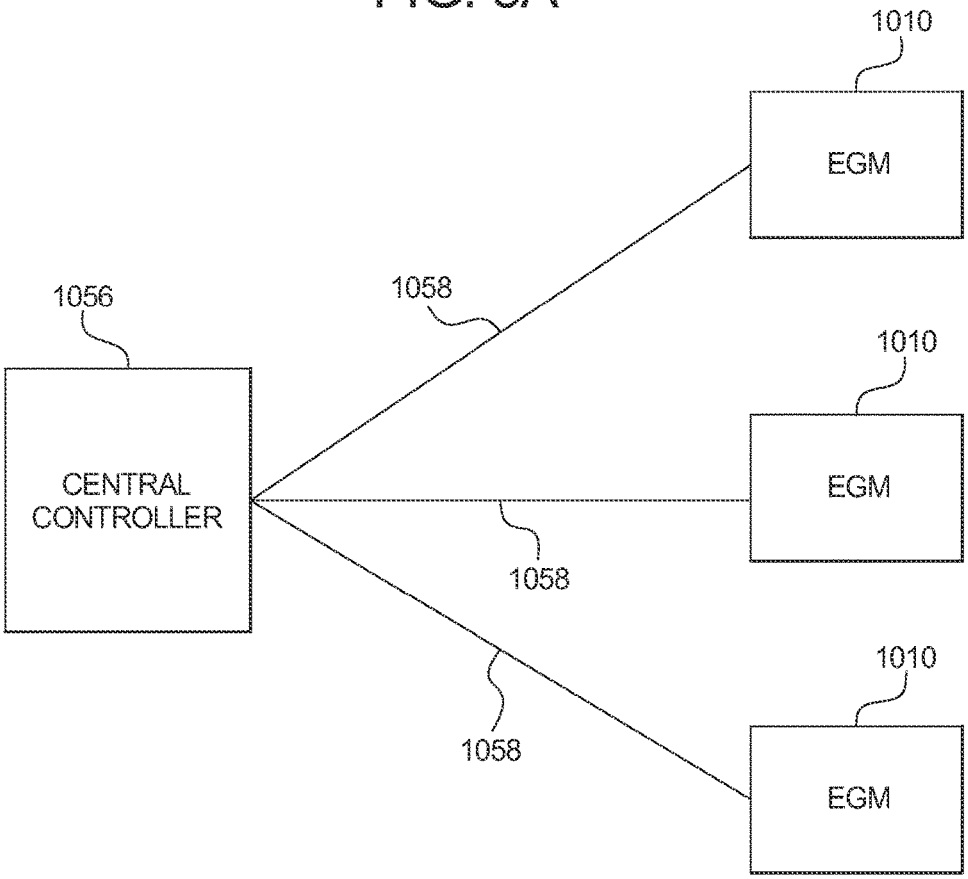
FIG. 5A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
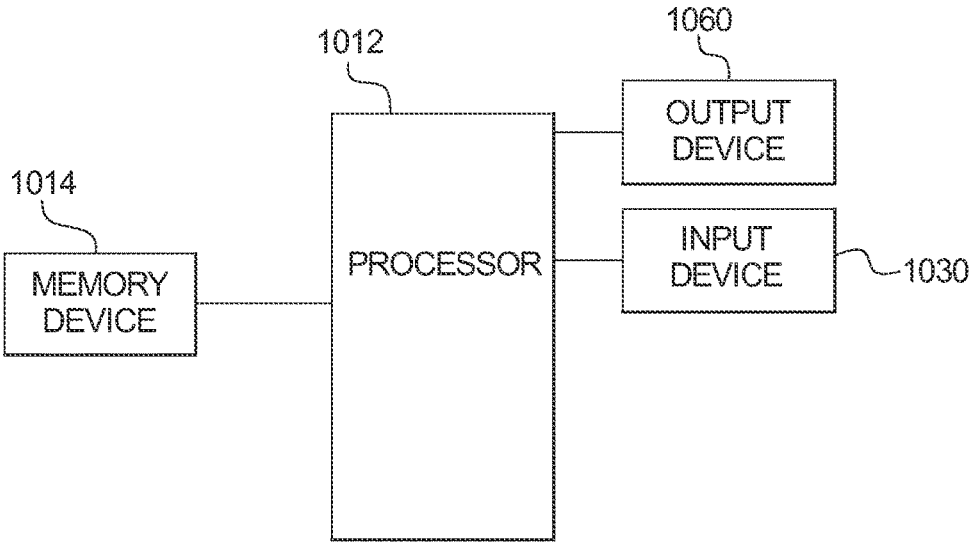
FIG. 5B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
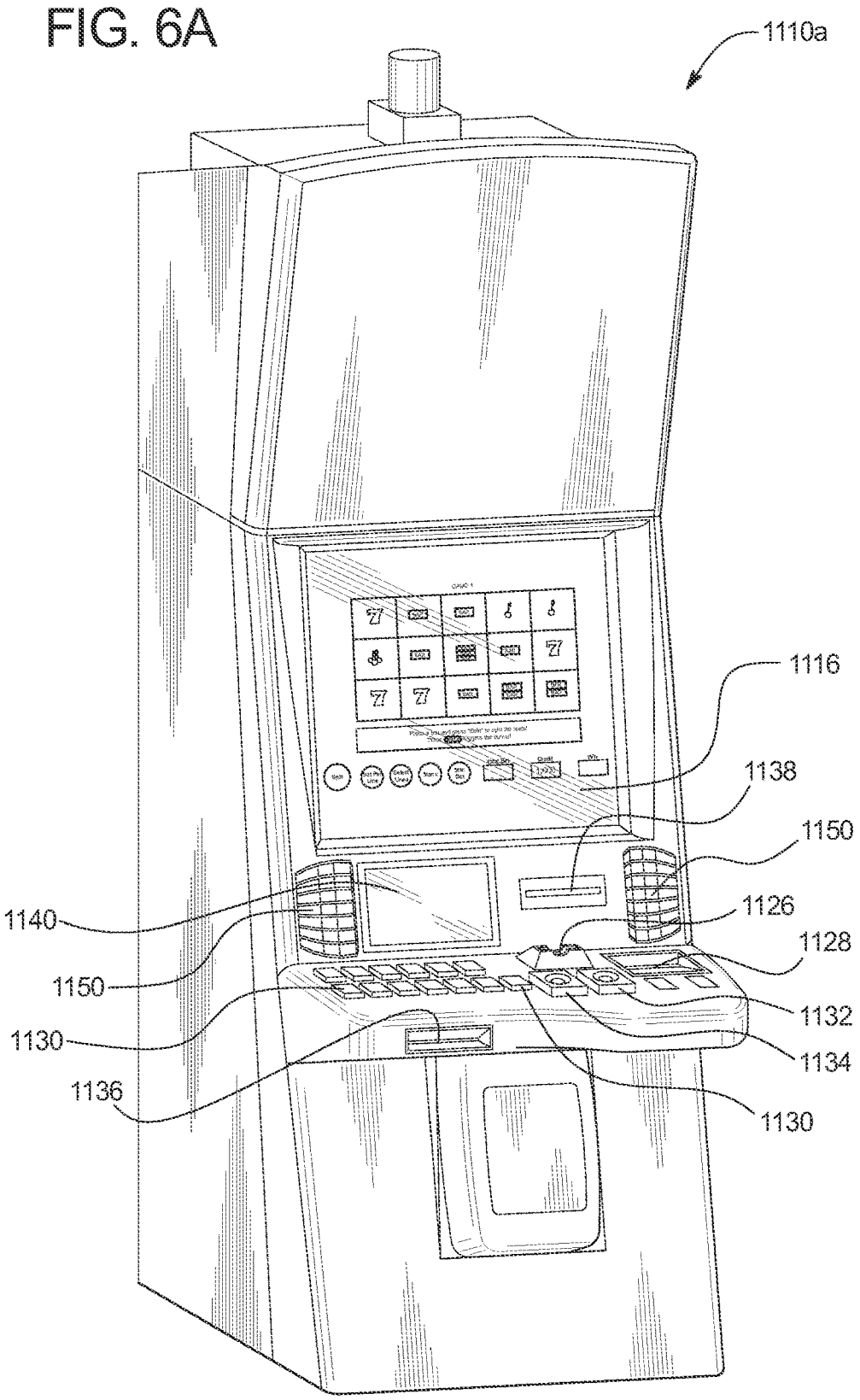
FIGS. 6A and 6B are perspective views of example alternative embodiments of the gaming system of the present disclosure.
Figure 6B:
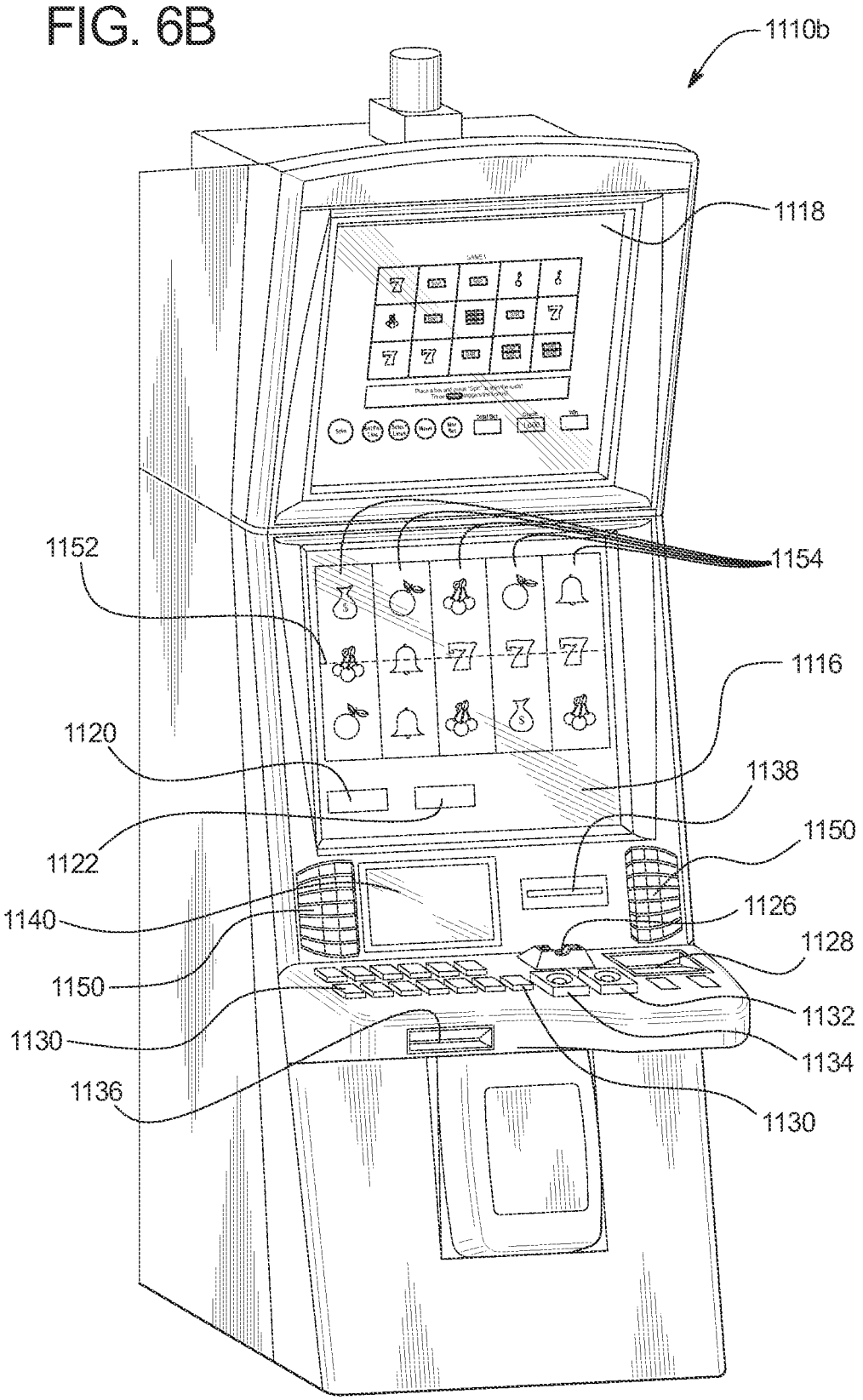

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs 1110*a* and 1110*b* that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs 1110*a* and 1110*b* illustrated in FIGS. 6A and 6B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. The example EGMs 1110*a* and 1110*b* illustrated in FIGS. 6A and 6B each include one or more input devices 1130.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs 1110*a* and 1110*b* illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated 1110*a* in FIG. 6A includes a central display device 1116, a player tracking display 1140, a credit display 1120, and a bet display 1122. The example EGM 1110*b* illustrated in FIG. 6B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs 1110*a* and 1110*b* illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs 1110*a* and 1110*b* illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs 1110*a* and 1110*b* illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 1110*a* and 1110*b* shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patters are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **1110*b* shown in FIG. 6B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electronic gaming machine comprising:

at least one processor; and at least one memory device that stores a plurality of instructions which, when executed by the at least one processor, cause the at least one processor to:

(a) responsive to a physical item being received via a payment acceptor, modify a credit balance based, at least in part, on a monetary value associated with the received physical item, wherein the physical item is selected from the group consisting of: a ticket associated with the monetary value and a unit of currency;

(b) enable a first player to make a first input to customize how the electronic gaming machine operates by during a first period of time following an occurrence of a first bonus triggering event in association with a play of a first primary game including a first set of one or more features:

(i) modifying a customizable bonus game to include one of the features of the first set that is not included in a second set of one or more features of a second primary game, the second primary game being different from the first primary game, the customizable bonus game being different from the first primary game and the second primary game, (ii) causing at least one display device to display a play of said modified customizable bonus game, wherein the play of the modified customizable bonus game comprises a first interactive bonus game and the credit balance is increasable based on any award amount determined in association with the play of said modified customizable bonus game, and (iii) causing a memory device to retain data associated with the modified customizable bonus game;

(c) enable a second player to make a second input to further customize how the electronic gaming machine operates by, during a second period of time subsequent to the first period of time and following an occurrence of a second bonus triggering event in association with a play of the second primary game, (i) retrieving the retained data associated with the modified customizable bonus game, (ii) further modifying the modified customizable bonus game to include one of the features of the second set that is not included in the first set of features of the first primary game, and (iii) causing the at least one display device to display a play of said further modified customizable bonus game, wherein the play of the further modified customizable bonus game comprises a second interactive bonus game and the credit balance is increasable based on any award amount determined in association with the play of said further modified customizable bonus game; and (d) responsive to a cashout input being received, cause an initiation of any payout associated with the credit balance.

2. The electronic gaming machine of claim 1, wherein the plurality of instructions, when executed by the at least one processor, cause the at least one processor to, enable the second player to make a third input to customize how the electronic gaming machine operates by, during a third period of time subsequent to the second period of time, modifying the further modified customizable bonus game by removing one of the features of the customizable bonus game.

3. The electronic gaming machine of claim 1, wherein the plurality of instructions, when executed by the at least one processor, cause the at least one processor to, during the first period of time following the occurrence of the first bonus triggering event in association with the play of the first primary game, responsive to determining that the customizable bonus game already includes all of the features of the first set that are not included in the second set, modify the customizable bonus game to include one of the features in the first set that is also included in the second set.

4. The electronic gaming machine of claim 1, wherein the first player and the second player are the same player.

5. A electronic gaming machine comprising:

at least one processor; and at least one memory device that stores a plurality of instructions which, when executed by the at least one processor, cause the at least one processor to:

(a) responsive to a physical item being received via a payment acceptor, modify a credit balance based, at least in part, on a monetary value associated with the received physical item, wherein the physical item is selected from the group consisting of: a ticket associated with the monetary value and a unit of currency;

(b) enable a first player to make a first input to customize how the electronic gaming machine operates by during a first period of time following an occurrence of a first bonus triggering event in association with a play of a first primary game causing at least one display device to display a play of a first bonus game having a first set of one or more features, at least one of the one or more features of the first set being a feature included in the first primary game and not included in a second primary game different from the first primary game, the first bonus game being different from the first primary game and the second primary game, and the credit balance being increasable based on any award amount determined in association with the play of said first bonus game;

(c) enable a second player to make a second input to customize how the electronic gaming machine operates by, during a second period of time subsequent to the first period of time and following a modification retention event occurring in association with the displayed play of the first bonus game during the first period of time and an occurrence of a second bonus triggering event in association with a play of the second primary game, causing the at least one display device to display a play of a second bonus game having a second set of one or more features, the second set of one or more features including the one or more features of the first set and at least one additional feature, the at least one additional feature being a feature included in the second primary game and not included in the first primary game, and the credit balance being increasable based on any award amount determined in association with the play of said second bonus game; and (d) responsive to a cashout input being received, cause an initiation of any payout associated with the credit balance.

6. The electronic gaming machine of claim 5, wherein the plurality of instructions, when executed by the at least one processor, cause the at least one processor to, enable the second player to make a third input to customize how the electronic gaming machine operates by, during a third period of time following an occurrence of a third bonus triggering event in association with another play of the first primary game, causing the at least one display device to display a play of a third bonus game having a third set of one or more features, the third set of one or more features not including at least one of the one or more features of the first set and including the at least one additional feature included in the second primary game and not included in the first primary game.

7. The electronic gaming machine of claim 6, wherein the third bonus game includes at least one feature included in both the first primary game and the second primary game.

8. The electronic gaming machine of claim 5, wherein the first player and the second player are the same player.

9. A method of operating an electronic gaming machine, said method comprising:

(a) enabling a first player to make a first input to customize how the electronic gaming machine operates by during a first period of time following an occurrence of a first bonus triggering event in association with a play of a first primary wagering game which is played responsive to a placement of a wager amount, wherein a credit balance is decreased based on the placed wager amount, the credit balance is increasable via a payment acceptor of a physical item associated with a monetary value, the credit balance is decreasable responsive to a cashout input, the physical item is selected from the group consisting of: a ticket associated with the monetary value and a unit of currency and the first primary wagering game includes a first set of one or more features:

(i) modifying, by at least one processor, a customizable bonus game to include one of the features of the first set that is not included in a second set of one or more features of a second primary wagering game, the second primary wagering game being different from the first primary wagering game, the customizable bonus game being different from the first primary wagering game and the second primary wagering game, (ii) causing, by the at least one processor, at least one display device to display a play of said modified customizable bonus game, wherein the play of the modified customizable bonus game comprises a first interactive bonus game and the credit balance is increasable based on any award amount determined in association with the play of said modified customizable bonus game, and (iii) retaining, by a memory device, data associated with the modified customizable bonus game; and (b) enabling a second player to make a second input to customize how the electronic gaming machine operates by during a second period of time subsequent to the first period of time and following an occurrence of a second bonus triggering event in association with a play of the second primary wagering game which is played responsive to a placement of another wager amount, wherein the credit balance is decreased based on the other placed wager amount:

(i) retrieving, by the at least one processor, the retained data associated with the modified customizable bonus game, (ii) further modifying, by the at least one processor, the modified customizable bonus game to include one of the features of the second set that is not included in the first set of features of the first primary wagering game, and (iii) causing, by the at least one processor, the at least one display device to display a play of said further modified customizable bonus game, wherein the play of the further modified customizable bonus game comprises a second interactive bonus game and the credit balance is increasable based on any award amount determined in association with the play of said further modified customizable bonus game.

10. The method of claim 9, which includes enabling the second player to make a third input to customize how the electronic gaming machine operates by modifying, by the at least one processor and during a third period of time subsequent to the second period of time, the further modified customizable bonus game by removing one of the features of the customizable bonus game.

11. The method of claim 9, which includes, at the first period of time following the occurrence of the first bonus triggering event in association with the play of the first primary wagering game, responsive to determining that the customizable bonus game already includes all of the features of the first set that are not included in the second set, modifying, by the at least one processor, the customizable bonus game to include one of the features in the first set that is also included in the second set.

12. The method of claim 9, wherein the first player and the second player are the same player.

13. The method of claim 9, which is provided through a data network.

14. The method of claim 13, wherein the data network is an internet.

15. A method of operating an electronic gaming machine, said method comprising:

(a) enabling a first player to make a first input to customize how the electronic gaming machine operates by, during a first period of time following an occurrence of a first bonus triggering event in association with a play of a first primary wagering game which is played responsive to a placement of a wager amount, causing, by at least one processor, at least one display device to display a play of a first bonus game having a first set of one or more features, at least one of the one or more features of the first set being a feature included in the first primary wagering game and not included in a second primary wagering game different from the first primary wagering game, the first bonus game being different from the first primary wagering game and the second primary wagering game, wherein the credit balance is decreased based on the placed wager amount, the credit balance is increasable based on any award amount determined in association with the play of said first bonus game, the credit balance is increasable via a payment acceptor of a physical item associated with a monetary value, the credit balance is decreasable responsive to a cashout input, and the physical item is selected from the group consisting of: a ticket associated with the monetary value and a unit of currency; and (b) enabling a second player to make a second input to customize how the electronic gaming machine operates by, during a second period of time subsequent to the first period of time and following a modification retention event occurring in association with the displayed play of the first bonus game during the first period of time and an occurrence of a second bonus triggering event in association with a play of the second primary wagering game which is played responsive to a placement of another wager amount, causing, by the at least one processor, the at least one display device to display a play of a second bonus game having a second set of one or more features, the second set of one or more features including the one or more features of the first set and at least one additional feature, the at least one additional feature being a feature included in the second primary wagering game and not included in the first primary wagering game, wherein the credit balance is decreased based on the placed other wager amount and the credit balance is increasable based on any award amount determined in association with the play of said second bonus game.

16. The method of claim 15, which includes, enable the second player to make a third input to customize how the electronic gaming machine operates by, during a third period of time following an occurrence of a third bonus triggering event in association with another play of the first primary wagering game, causing, by the at least one processor, the at least one display device to display a play of a third bonus game having a third set of one or more features, the third set of one or more features not including at least one of the one or more features of the first set and including the at least one additional feature included in the second primary wagering game and not included in the first primary wagering game.

17. The method of claim 16, wherein the third bonus game includes at least one feature included in both the first primary wagering game and the second primary wagering game.

18. The method of claim 15, wherein the first player and the second player are the same player.

19. The method of claim 15, which is provided through a data network.

20. The method of claim 19, wherein the data network is an internet.

* * * * *